US007152526B2

(12) United States Patent
Urata et al.

(10) Patent No.: US 7,152,526 B2
(45) Date of Patent: Dec. 26, 2006

(54) SURFACE TREATED DOCTOR BLADE

(75) Inventors: Kazuya Urata, Saitama (JP); Naoyuki Oniwa, Saitama (JP); Kunio Tachibana, Saitama (JP)

(73) Assignee: Nihon New Chrome Co., Ltd., Tokyo (JP)

( * ) Notice: Subject to any disclaimer, the term of this patent is extended or adjusted under 35 U.S.C. 154(b) by 0 days.

(21) Appl. No.: 10/502,926

(22) PCT Filed: Jan. 28, 2002

(86) PCT No.: PCT/JP03/00777

§ 371 (c)(1),
(2), (4) Date: Jul. 28, 2004

(87) PCT Pub. No.: WO03/064157

PCT Pub. Date: Aug. 7, 2003

(65) Prior Publication Data

US 2005/0089706 A1 Apr. 28, 2005

(30) Foreign Application Priority Data

Jan. 29, 2002 (JP) ..... 2002-020332
Jan. 31, 2002 (JP) ..... 2002-023622
Feb. 4, 2002 (JP) ..... 2002-027412

(51) Int. Cl.
*D21G 3/00* (2006.01)
*B41F 9/10* (2006.01)

(52) U.S. Cl. ..... 101/157; 15/256.51; 428/679
(58) Field of Classification Search ..... None See application file for complete search history.

(56) References Cited

U.S. PATENT DOCUMENTS 3,838,512 A * 10/1974 Sanderson ..... 30/346.54
3,911,579 A * 10/1975 Lane et al. ..... 30/346.54
4,139,942 A * 2/1979 Sastri et al. ..... 30/346.54
5,795,648 A * 8/1998 Goel et al. ..... 428/336
5,947,021 A 9/1999 Coleman et al.
6,335,098 B1 * 1/2002 Kutzner et al. ..... 428/422
6,684,513 B1 * 2/2004 Clipstone et al. ..... 30/346.54
6,841,264 B1 * 1/2005 Lunnerfjord et al. ..... 428/679
2003/0121158 A1 * 7/2003 Clipstone et al. ..... 30/346.54

FOREIGN PATENT DOCUMENTS

DE 2044165 * 3/1971
DE 1553843 * 2/1976
EP 0061093 9/1982
JP 03-064595 3/1991
JP 04-070343 5/1992

(Continued)

*Primary Examiner*—John J. Zimmerman
(74) *Attorney, Agent, or Firm*—Dennis G. LaPointe

(57) ABSTRACT

Disclosed is a surface treated doctor blade in which the surface of at least the blade edge portion thereof consists of a surface treatment coating film composed of a first layer consisting of a specific nickel-based plating and a second layer provided thereon which has low surface energy, and in which preferably at least a part of the blade edge end portion of the blade base material is exposed. In the surface treated doctor blade of the present invention, it is possible to improve wear resistance of the blade edge end and to suppress generation of printing failures during continuous printing. Further, in the mode in which at least a part of the blade base material is exposed, it is possible to reduce running-in time for adjustment of contact of the blade edge with the cylinder after replacement of the doctor blade.

6 Claims, 2 Drawing Sheets

FOREIGN PATENT DOCUMENTS

| | | | |
|---|---|---|---|
| JP | 04-296556 | | 10/1992 |
| JP | 04-312889 | * | 11/1992 |
| JP | 2001-001664 | | 1/2001 |
| JP | 2001-080230 | | 3/2001 |
| WO | WO 98/18625 | | 5/1998 |
| WO | WO 02/46526 A1 | * | 6/2002 |

* cited by examiner

SURFACE TREATED DOCTOR BLADE

RELATED APPLICATION

This application is a 35 USC 371 national stage application of international application PCT/JP03/00777 filed Jan. 28, 2003.

TECHNICAL FIELD

The present invention relates to a doctor blade having on its surface a double-layered coating film. More specifically, the present invention relates to a surface treated doctor blade which is superior in suppressing a printing failure attributable to the doctor blade that is caused during continuous printing.

BACKGROUND ART

As shown in FIG. 1 and FIG. 2 (which is a partial enlarged view of FIG. 1; it is to be noted that in both FIGS. 1 and 2, the blade portion is, for ease of understanding, depicted extremely large as compared with the cylinder), in gravure (intaglio) printing, a cylinder (1) having on its peripheral surface a large number of minute recesses (not shown) called cells corresponding to an image is used. A doctor blade (2) formed of steel or stainless steel is pressed against the peripheral surface of this cylinder with a fixed pressure, thereby scraping off ink (3) adhering to a non-image portion of the plate surface. This doctor blade serves to completely remove the ink of the non-image portion and to leave a predetermined amount of ink on the image portion, so that the contact pressure of the cylinder and the doctor blade has to be always maintained at a fixed level, and the edge part of the blade is required to have wear resistance. Thus, a doctor blade which has undergone surface treatment such as plating (4) is generally used.

For example, there are proposed: (1) in JP 4-296556 A, a doctor blade whose edge portion has a surface formed of an ink-repellent material (metal plating containing polymer particles);

(2) in JP 2001-80230 A, a backing-of-a-spatula preventing doctor blade whose surface has undergone fluorine-containing treatment (e.g., a metal plating of eutectoid 4-fluorinated ethylene resin particles);

(3) in JP 2000-507523 A, a doctor blade whose surface is coated with a polymer having a poor surface energy of 10 to 60 mN/m; and (4) in JP 3-64595 A, a surface treated doctor blade consisting of a first layer of a nickel-based alloy and an upper layer of a chromium plating and superior in rust resistance and wear resistance.

(5) In JP 2952333 B, there is proposed a method of manufacturing a doctor blade having a double-layered plating consisting of a first layer of Ni plating and an upper layer of Ni plating containing ceramic powder.

(6) In JP 2001-1664 A, there is proposed a doctor blade in which the surface of the blade core metal is coated with a primer plating coating film and a diamond-like carbon coating film formed thereon, the primer plating being harder than the core metal and softer than the diamond-like carbon coating film.

However, these prior-art techniques have the following problems:

In the technique as proposed in (1), the surface of the blade edge is ink repellent, and doctoring is performed without extracting the ink from the cells of the plate, whereby it is possible to fill the cells with ink in a satisfactory manner, and even in precision printing, the configurations of the pixels can be reproduced in a satisfactory manner. However, since the surface treatment is effected with a single layer of metal containing ink repellent polymer particles, the wear resistance is insufficient, and as continuous printing is conducted, the wear of the blade edge progresses rapidly, so that it is necessary to frequently replace the blade, resulting in reduction in printing efficiency.

In the technique as proposed in (2), coating is effected on a blade solely by metal plating in a single layer containing 4-fluorinated ethylene resin particles, whereby it is possible to effectively prevent a printing failure called "backing of a spatula", in which during continuous printing, coating liquid is accumulated and grows on the back side of the blade edge (back side with respect to the direction to which the cylinder rotates (R side in FIG. 2)), and the accumulated liquid drops are irregularly transferred to the original form to swell in dots or streaks. However, with the metal plating using eutectoid 4-fluorinated ethylene resin particles alone, it is impossible to obtain a sufficient degree of wear resistance since the plating is relatively soft, and the wear of the blade edge progresses rapidly with continuous printing, so that it is necessary to frequently replace the blade, resulting in a deterioration in printing efficiency. Further, with this single layer plating alone, a failure in scraping ink off the cylinder is likely to occur, and a printing failure (fog or the like) assumed to be attributable to the scraping failure occurs in a relatively early stage of continuous printing.

In the technique as proposed in (3), the blade surface is coated with a polymer with a poor surface energy to thereby prevent ink deposit when a high viscosity ink is used. However, since the substance with which the blade is coated is a polymer, the wear resistance of the blade is not improved at all, and it is necessary to frequently replace the blade as a result of the wear of the blade edge, resulting in a low production efficiency. Further, a failure in scraping chemical liquid off the cylinder is likely to occur, and a printing failure (fog or the like) occurs at a relatively early stage of printing.

In the techniques as proposed in (4) and (5), double-layered plating is effected to thereby enhance adhesion of the upper plating layer, and the wear resistance of the blade edge is improved by chromium plating forming the outermost layer or ceramic-containing-nickel plating. Although the techniques are effective in mitigating the wear of the blade, since the plating coating film forming the outermost layer is hard, there is a problem in that a printing failure due to acceleration of the wear of the cylinder itself, damage of the cylinder, peeling of the plating coating film or the like is likely to occur.

In the technique as proposed in (6), two-layer treatment is adopted using a ceramic composite nickel coating film and a diamond-like carbon coating film, thereby preventing plate fog due to a failure in scraping ink off when using aqueous ink. However, this technique has a problem in that adhesion between the diamond-like carbon coating film and the ceramic composite nickel coating film is insufficient. As the blade edge end is worn during continuous printing, the upper layer is likely to be peeled, and the resultant peeled powder is mixed with the ink, so that printing failure is likely to occur. Further, there is a problem in that the production efficiency when providing the diamond-like carbon coating film is rather low, and the provision requires a special apparatus such as a plasma deposition apparatus, with the result that a production cost itself is high, or the like.

Further, it has recently become more difficult to meet the user needs for accuracy. There is a requirement for a more accurate reproducibility for image configuration, and minute image defects such as bleeding and blurring which were overlooked in the past matter much more nowadays. This problem cannot be solved by the prior-art techniques.

It is accordingly an object of the present invention to provide a surface treated doctor blade which solves the above problems in the prior art and which helps to improve the wear resistance of the blade edge end and suppresses occurrence of printing failure during continuous printing.

On the other hand, in the doctor blades according to the prior-art techniques (1) to (6), the blade edge end is completely covered with plating (like the embodiment of the present invention as shown by FIG. 3(*c*)). Thus, when printing is performed immediately after replacing the blade with a new blade, a printing failure such as streaking or fog is generated due to defective contact between the cylinder and the blade edge end. In view of this, it is general practice to conduct a running-in for 30 to 60 minutes in order for the blade to obtain a good fit with the cylinder (conformability) which the blade contacts with, and then perform actual printing. As a result, there are problems in that a time loss corresponding to the running-in is involved, which means a very poor printing efficiency, and moreover, the cylinder can be damaged during the running-in, or partial wear can occur on the blade (hereinafter, such problems will be collectively referred to as "conformability of the blade").

Thus, another object of the present invention is to provide a surface treated doctor blade improved in conformability between cylinder and blade edge end to thereby reduce running-in time, superior in wear resistance of the blade edge end, which can suppress occurrence of printing failure during continuous printing.

DISCLOSURE OF THE INVENTION

After examining causes of printing failure during continuous printing, the present inventors have found out the following facts.

It is to be assumed that printing failures in the form of bleeding, blurring, fogging, etc. of the image generated between the early stage and the middle stage of continuous printing are mainly attributable to a failure in scraping ink off by the blade. To overcome this, the following measures (1) and (2) have been found to be effective.

(1) To reduce the surface energy of the outermost treated blade surface at least on the front side (the front side with respect to the direction to which the cylinder rotates) of the blade edge end in contact with the ink. It is to be assumed that by reducing the surface energy, the surplus ink scraped off the non-image portion does not stay due to the ink repellency of the coating film, and is efficiently discharged from the system through the contact area between cylinder and blade (portion a in FIG. 2), with the result that engulfing of ink into the inner portion (failure in scraping off of ink by the blade) is restrained.

(2) To set the surface hardness of the blade after treatment within a specific range. It is to be assumed that by setting plating hardness within a specific range, it is possible for the blade to apply a stable, uniform, and sufficient pressure onto the cylinder, thereby improving the ink scraping performance.

Further, the printing failure generated at the late stage of continuous printing is mainly attributable to wear of the blade edge end, missing plating, damage and wear of the cylinder. It has been found out that these can be effectively restrained by the following measures:

(3) To reduce coefficient of friction of the blade surface, that is, to enhance lubricity of the surface and restrain cohesion wear at the point of contact between the blade and the cylinder;

(4) To set surface hardness within a specific range; and (5) To set film thickness within a specific range.

As stated above, to obtain a satisfactory printing performance for continuous printing, it is necessary for the doctor blade to satisfy all of the above (1) to (5) at the same time. With the prior-art techniques, it is difficult to satisfy all the above conditions. It has been found out that this becomes possible only by adopting the double-layered plating structure as proposed in the present invention and allotting different functions to each plating layer.

Further, the present inventors conducted studies on conformability of the blade edge end, and have found out the following facts.

(6) To improve conformability of the blade edge end, it is effective to reduce hardness of the blade edge end portion (5 in FIG. 3), which is the first part of the blade to come into contact with the cylinder. It is not definitely known why this improves the conformability of the blade edge end. However, it is to be assumed that by reducing the hardness, deformation of the blade edge end when being pressed on the cylinder is encouraged, and as a result, the area of the blade portion coming into contact with the cylinder increases, which contributes to improvement in conformability of the blade edge end. Specifically, it is most effective to expose the blade base material exclusively at the blade edge end.

(7) Further, in order to prevent partial wear during running-in time which is caused by exposure of the blade base material for increasing the area coming into contact with the cylinder, it is necessary to provide a coating film having lubricity on surface treated portion of the blade edge other than the portion where the base material is exposed.

It has been confirmed that, in order to improve conformability of the blade edge end, in addition to improvement of the ink scraping property and property for continuous printing (wear resistance), it is effective to form the surface treatment coating film in a double-layered structure to allot different functions to each coating film layer and to expose only the blade edge end portion of the blade base material.

That is, the present invention provides the following:

1. A surface treated doctor blade, wherein a surface of at least the blade edge portion of base material comprises a first layer consisting of a nickel-based plating or a chromium-based plating (exclusive of an organic resin dispersed composite plating in which organic resin particles are dispersed) and a second layer provided thereon which has low surface energy.
2. The surface treated doctor blade as described in above item 1, wherein the plating of the first layer is a nickel-phosphorus-based composite plating containing ceramic particles.
3. The surface treated doctor blade as described in above item 2, wherein the particle size of the ceramic particles is 0.05 to 10 μm.
4. The surface treated doctor blade as described in above item 2, wherein the ceramic particles are SiC particles.
5. The surface treated doctor blade as described in above item 1, wherein the second layer is a layer consisting of an organic resin dispersed composite plating containing fluorine-based resin particles.

6. The surface treated doctor blade as described in above item 5, wherein the type of the fluorine-based resin particles is at least one type of particle selected from a group consisting of tetrafluoroethyelene-based resin, perfluoroalkoxy-based resin, and fluorinated ethylene propylene-based resin.
7. The surface treated doctor blade as described in above item 6, wherein the particle size of the fluorine-based resin particles is 0.05 to 10 μm.
8. The surface treated doctor blade as described in above item 7, wherein the particle size of the fluorine-based resin particles is not more than 1.2 times the plating thickness of the second layer.
9. The surface treated doctor blade as described in above item 1, wherein the second layer consists of an organic resin coating film layer having low surface energy.
10. The surface treated doctor blade as described in above item 9, wherein the organic resin coating film is at least one type of organic resin coating film selected from silicone-based resin, fluorine-based resin, and an organic resin containing particles of silicone-based resin and/or fluorine-based resin.
11. The surface treated doctor blade as described in above item 9, wherein the organic resin coating film is at least one type of organic resin coating film selected from a group consisting of tetrafluoroethylene-based resin, perfluoroalkoxy-based resin, fluorinated ethylene propylene-based resin, and an organic resin containing these resins in the form of particles.
12. The surface treated doctor blade as described in above item 1, wherein blade base material of the blade edge end portion is exposed at least in a part.
13. The surface treated doctor blade as described in above item 1, wherein Vickers hardness (Hv) of the doctor blade is within a range of 400 to 1500.
14. The surface treated doctor blade as described in any one of above items 1 to 13, wherein the sum total of a film thickness (A) of the first layer and a film thickness (B) of the second layer is within a range of 2 μm to 30 μm.
15. A surface treated doctor blade as described in above item 14, wherein the ratio (B/A) of the film thickness (B) of the second layer to the film thickness (A) of the first layer is within a range of 0.005 to 1.3.

DETAILED DESCRIPTION OF THE INVENTION

Figure 1:
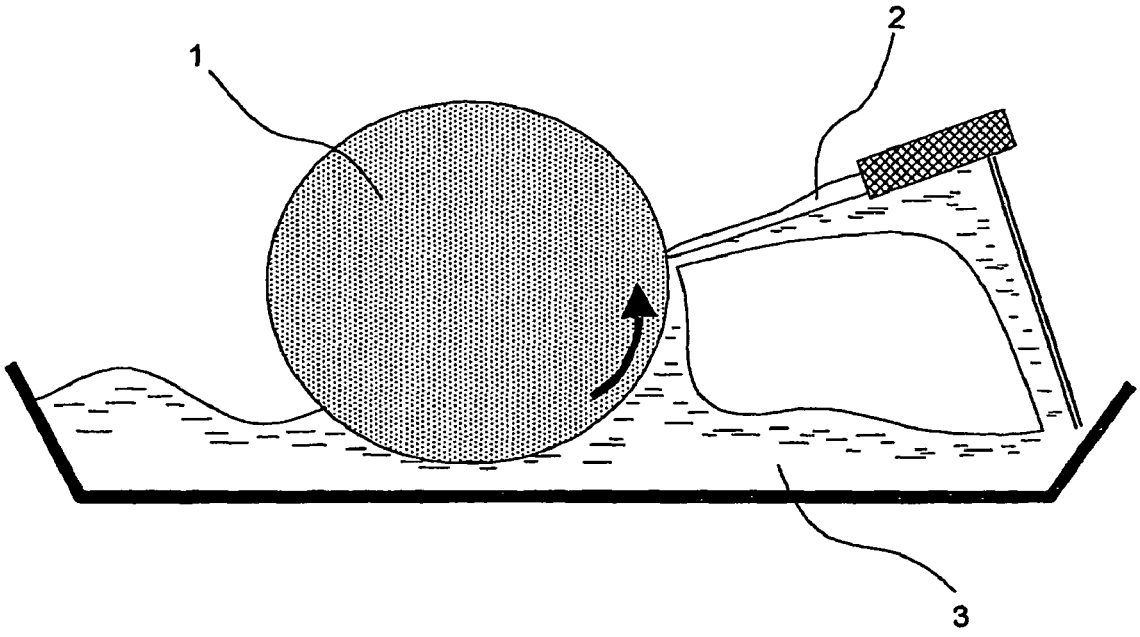
FIG. 1 is a conceptual drawing illustrating gravure (intaglio) printing using a doctor blade.

The present invention will now be described in detail.

In the present invention, any doctor blade base material can be used as long as it is a publicly-known base material of steel or stainless steel for use in printing and coating.

Normally, a doctor blade base material undergoes a processing such as stepping so that its side edge constituting the blade edge end portion may be formed as a sharp edge, and it can assume any one of the following configurations: parallel edge, inclined (bevel) edge, round edge, and square edge. Further, according to the usage, the present invention is applicable to both a one-side type blade in which such blade edge end processing is conducted only on one side of the blade and a double-side type blade in which such processing is conducted on both sides of the blade.

In the present invention, there is no limitation regarding the size of the blade base material. For example, a typical blade base material consists of a band-shaped steel plate having a thickness of 0.15 mm to 0.6 mm and a width of 40 to 60 mm.

In the surface treated doctor blade of the present invention, at least the surface of the blade edge portion of the base material has a double-layered structure composed of a first layer consisting of a nickel-based plating or a chromium-based plating (exclusive of an organic resin dispersed composite plating in which organic resin particles are dispersed) and a second layer having low surface energy which is provided thereon. More preferably, the second layer consists of an organic resin dispersed composite plating layer containing fluorine-based resin particles or an organic resin coating layer having low surface energy.

The plating of the first layer mainly serves to impart hardness to the blade; a nickel-based plating or a chromium-based plating is effective. It is to be noted that none of nickel-based dispersed composite plating, chromium-based dispersed composite plating in which organic resin particles are dispersed and plating other than those mentioned above is employed in the present invention, since such a plating cannot attain a predetermined degree of hardness or does not have sufficient adhesiveness with blade material. Thus, these types of plating are to be excluded in the present invention.

The term "nickel-based plating" refers to a pure nickel plating, an alloy plating such as nickel-cobalt, nickel-iron, nickel-chromium, nickel-tungsten, nickel-manganese, nickel-tin, nickel-phosphorus, nickel-boron, and nickel-phosphorus-boron, or a nickel-based dispersed plating in which particles other than organic resin, for example, at least one type of particle selected from a group consisting of $Al_2O_3$, $Cr_2O_3$, $Fe_2O_3$, $TiO_2$, $ZrO_2$, $ThO_2$, $SiO_2$, $CeO_2$, $BeO_2$, MgO, CdO, diamond, SiC, TiC, WC, VC, ZrC, TaC, $Cr_3C_2$, $B_4C$, BN, $ZrB_2$, TiN, $Si_3N_4$, $WSi_2$, and the like is dispersed in the matrix composed of those nickel-based metals. Any of the above-mentioned platings may be used as the nickel-based plating.

Also, the term "chromium-based plating" refers to a pure chromium plating, an alloy plating such as chromium-tungsten and chromium-iron, or a chromium-based dispersed plating in which a particle other than an organic resin, for example, at least one type of particle selected from $Al_2O_3$, $TiO_2$, $ZrO_2$, $SiO_2$, $CeO_2$, $UO_2$, SiC, WC, $ZrB_2$, $TiB_2$, and the like is contained in the matrix composed of those chromium-based metals. Any of the above-mentioned platings may be used as the chromium-based plating.

Note that, in both case of the nickel-based plating and the chromium-based plating, other components such as organic resins, in addition to the above-mentioned fine particles, can be contained in a small amount in the matrix as far as the amount is within a range that does not adversely affect the present invention.

Among those nickel-based plating and chromium-based plating, as plating for a first layer, those in which ceramic particles are dispersed, particularly, nickel-based composite plating in which SiC particles are dispersed is preferred. Among those, the nickel-phosphorous-based alloy plating is most preferred.

Preferably, the particle size of the ceramic particles used in the present invention is 0.05 μm to 10 μm. When the particle size is less than 0.05 μm or exceeds 10 μm, property for continuous printing (wear resistance), ink scraping property, or adhesion of the plating deteriorates. In particular, the particle size preferably ranges from 0.1 μm to 2 μm, and more preferably, from 0.15 μm to 1 μm.

The ceramic particle content in the plating is preferably 0.5 vol % to 40 vol %. When the content is less than 0.5 vol %, the effect of improving property for continuous printing (wear resistance) cannot be obtained. When the content exceeds 40 vol %, the plating adhesion deteriorates undesirably. In particular, the content is preferably 3 vol % to 30 vol %, and more preferably, 5 vol % to 25 vol %.

The coating of the second layer has the following functions:

(1) it lowers surface energy of the blade surface and imparts ink-repellency thereto, whereby surplus ink scraped off the non-image portion is not allowed to stay on the surface, and the discharge of ink to the exterior of the system from the contact area between the cylinder and the blade (portion a in FIG. 2) is facilitated, while intrusion of ink into the contact area between the blade and the cylinder is restrained; and (2) it improves lubricity at the contact area between blade and cylinder, thereby mitigating wear of the blade and the cylinder due to adhesion at the point of contact between the blade and the cylinder. As the second layer, a low surface energy coating is effective.

Here, a low surface energy coating means a coating having ink-repellency and lubricity. Specifically, it is a coating having a surface energy lower than at least that of a nickel-phosphorus dispersed plating in which SiC is dispersed. In particular, of such low surface energy coatings, an organic resin dispersed nickel-based composite plating containing fluorine-based resin particles, and a low surface energy organic resin coating are preferable. In the following, these two particularly preferable coatings will be described in detail.

(a) Organic Resin Dispersed Nickel-Based Composite Plating Containing Fluorine-Based Resin Particles The particle size of the fluorine-based resin particles used in this composite plating is preferably 0.05 μm to 10 μm. When the particle size is less than 0.05 μm, the adhesion with respect to the ground plating deteriorates, which is undesirable. On the other hand, when the particle size exceeds 10 μm, the resin particles are likely to come off the plating, making it impossible to obtain the effect of the present invention. More preferably, the particle size is 0.07 μm to 5 μm, still more preferably, 0.1 μm to 1 μm, and most preferably, 0.15 μm to 0.5 μm.

Further, it is desirable for the resin particle size of the fluorine-based resin be not more than 1.2 times the thickness of the plating layer in which the resin particles are dispersed. When the particle size exceeds 1.2 times the thickness, the fluorine-based resin is likely to come off the plating, making it impossible to obtain the effect of the present invention. Moreover, since the protruding fluorine-based resin excessively protrudes from the plating, printing streaks due to the fluorine-based resin are likely to be generated, undesirably. More preferably, the particle size is not more than 0.8 times the plating thickness, and most preferably, not more than 0.5 times the plating thickness.

Examples of the fluorine resin particles include particles of resins such as tetrafluoroethylene resin, perfluoroalkoxy resin, fluorinated ethylene propylene resin, tetrafluoroethylene/perfluoroalkyl vinyl ether copolymer resin, tetrafluoroethylene/ethylene copolymer resin, trifluoroethylene chloride resin and vinylidene fluoride resin. Among those resins, tetrafluoroethylene resin, perfluoroalkoxy resin, and fluorinated ethylene propylene resins are preferred. Tetrafluoroethylene resin is particularly preferred.

Also, as the metal matrix in which fluorine resin particles are dispersed, pure nickel plating, as well as nickel-based alloy plating such as nickel-cobalt, nickel-iron, nickel-chromium, nickel-tungsten, nickel-manganese, nickel-tin, nickel-phosphorus, nickel-boron, and nickel-phosphorus-boron are preferred. The nickel-phosphorus alloy is particularly preferred.

The content of fluorine-based resin particle contained in the plating is 2 vol % to 50 vol %. Preferably, it is 10 vol % to 40 vol %, and more preferably, 20 vol % to 30 vol %.

When the content is less than 2 vol %, it is impossible to obtain the effect of lowering the surface energy and improving the lubricity. When the content exceeds 50 vol %, the adhesion of the plating deteriorates.

As long as it does not interfere with effects of the present invention, the plating may contain a minute amount of ingredients other than the fluorine-based resin particles.

With a dispersion plating containing particles other than those of organic resin as dispersion material, it is impossible to obtain a surface having low surface energy and high lubricity required for the present invention, and such a dispersion plating is not suitable for the present invention. Further, even if contained by the same amount as the fluorine-based resin particles, organic resin particles other than fluorine-based resin particles cannot lower surface energy or improve lubricity to the same degree as fluorine-based resin particles can. In order for such resin particles to contribute to obtaining the same level of low surface energy as that obtained by using fluorine-based resin particles, the resin content in the plating has to be considerably excessive, making it impossible to obtain good adhesion of plating and wear resistance as required in the present invention.

(b) Organic Resin Films Having Low Surface Energy

Examples of the organic resin films having low surface energy include: perfluorolauric acid film; paraffin-based resin; polyolefin-based resins such as polyethylene and polypropylene; fluorine-based resins such as tetrafluoroethylene resin, perfluoroalkoxy resin, fluorinated ethylene propylene resin, tetrafluoroethylene/perfluoroalkyl vinyl ether copolymer resin, tetrafluoroethylene/ethylene copolymer resin, trifluoroethylene chloride resin, vinylidene fluoride resin, perfluorooctylethyl acrylate resin, fluorinated acrylic polymer, and fluorinated methacrylic polymer; silicone-based resin; imine-based resin; urethane-based resin, acrylic-based resin; and films comprising at least one resin selected from organic resins which contain the above-mentioned resin as particles. Among those, fluorine-based resin, silicone-based resin, and organic resin which contain particles of those fluorine-based resins or those silicone-based resins are preferred. Tetrafluoroethylene-based resins, perfluoroalkoxy-based resin, fluorinated ethylene propylene-based resins, perfluorooctylethyl acrylate resins, and organic resins which contain particles composed of those resins are particularly preferred.

An organic film other than the above cannot provide a low surface energy or is not resistant to ink, making it impossible to obtain the effect of the present invention.

Also, when resin particles of silicone-based resin or fluorine-based resin are dispersed in the organic resin, it is desirable that the particle size of the resin particles be 0.05 μm to 10 μm. When the particle size is less than 0.05 μm, the adhesion with respect to the ground plating deteriorates undesirably. On the other hand, the resin particles of a particle size exceeding 10 μm, which are likely to come off the coating, are not suitable for the present invention to obtain the effect of the present invention. The particle size is preferably 0.1 μm to 3 μm, and more preferably, 0.15 μm to 0.8 μm. The content of such resin particles is preferably 2 vol % to 50 vol %, and more preferably, 5 vol % to 35 vol %.

The organic resin used as the binder of the resin particles is selected from the viewpoint of resistance to ink. Examples of the organic resin to be used include acrylic resin, urethane-based resin, phenol-based resin, epoxy-based resin, imine-based resin, and polyolefin-based resin.

In the present invention, as long as it does not impair its effects, organic coating of the second layer can contain antirust pigment, extender pigment, coloring pigment, dye, etc.

The composite effects of the present invention can be obtained only through a combination of the first layer consisting of a specific nickel-based plating and the second layer consisting of a low surface energy film. When used alone, neither of these layers provides the effects of the present invention.

In the present invention, it is desirable that the degree of the surface hardness of the surface treated blade edge portion be 400 to 1500 in Vickers hardness (Hv). When its Vickers hardness (Hv) is less than 400, a failure in scraping ink off is likely to occur, and a printing defect such as defective image configuration is likely to be generated in the early stage of continuous printing. Further, property for continuous printing (wear resistance) also deteriorates. On the other hand, when the Vickers hardness exceeds 1500, the plating becomes brittle to be easily peeled off. Moreover, the blade will damage the plate surface of the cylinder, resulting in a printing failure. In particular, the Vickers hardness (Hv) is preferably 700 to 1300 and, more preferably, 800 to 1150.

In the present invention, the Vickers hardness (Hv) is measured according to the Vickers hardness test as prescribed in the microhardness test method of JIS Z 2251 (Regarding the test load, a load of less than 50 gf may be appropriately selected for use according to the coating film thickness).

In the present invention, the film thickness of the surface treatment coating film is determined such that the sum total film thickness (A+B) of film thickness (A) of the first layer and film thickness (B) of the second layer, is 2 μm to 30 μm. When the sum total coating film thickness of the two layers is less than 2 μm, it is impossible to obtain the effect of property for continuous printing (wear resistance), and therefore such a thickness is not suitable for the present invention. On the other hand, sum total coating film thickness exceeding 30 μm is disadvantageous from the economical viewpoint, and is not suitable for the present invention since property for continuous printing (wear resistance) and adhesion of the coating deteriorate. In particular, the total film thickness A+B is preferably within a range of 3 μm to 15 μm, and more preferably, within a range of 5 μm to 10 μm.

Further, it is desirable that the ratio (B/A) of the thickness (B) of the second layer to the thickness (A) of the first layer be not less than 0.005 and not more than 1.3. When the coating film thickness ratio is less than 0.005, ink scraping failure is likely to occur. When the ratio exceeds 1.3, property for continuous printing (wear resistance) deteriorates. In particular, the coating film thickness ratio B/A is preferably not less than 0.05 and not more than 0.6, and more preferably, not less than 0.1 and not more than 0.3.

A known measurement method can be employed for measurement of the plating thickness and the resin coating film thickness.

Examples of known measurement methods include: (1) a method in which film thickness is measured by using a fluorescent X-ray measurement apparatus, (2) a method in which the surface treatment coating is peeled off by means of a stripping solution to measure the film thickness based on the difference in weight before and after peeling, and (3) a method in which the vertical section is observed by an optical microscope or an electronic microscope to measure the plating thickness and the resin coating film thickness.

As a specific means for surface treatment, it is possible to adopt any one of known production techniques. For example, when the second layer is a plating coating, production may proceed through the following sequence of steps: degreasing, rinsing, activation, rinsing, plating, rinsing, plating, rinsing, and then drying, or the sequence of steps: degreasing, rinsing, activation, rinsing, plating, rinsing, (surface adjustment by at least one of the following: degreasing, acid treatment, polishing, rinsing, etc.), plating, rinsing, and then drying. When the second layer is a resin coating, production may proceed through the following sequence of steps: degreasing, rinsing, activation, rinsing, plating, rinsing, drying, coating, and baking, or the sequence of steps: degreasing, rinsing, activation, rinsing, plating, rinsing, drying, annealing, (in some cases, pre-treatment (degreasing, rinsing, etc.), drying), coating, and then drying/baking. On the blade which has undergone the above surface treatment, an appropriate combination of post-treatments such as annealing, surface polishing, blade edge adjustment, anti-corrosive oil application, and shearing into a predetermined size are conducted, whereby it is possible to obtain a desired doctor blade.

As plating means, publicly-known plating technique, such as electroplating or electroless plating may be employed.

As coating means, publicly-known coating process, such as bar coater method, roll coater method, brush application, spray method, or immersion method may be employed, to apply a coating material consisting of a predetermined resin to a predetermined thickness.

As means for drying the coating layer, publicly-known drying means, such as a hot-air drying furnace or an induction heater may be employed.

In the present invention, in order to improve the adhesion between the blade base material and the plating of the first layer and/or between the plating of the first layer and the second layer coating film and to promote the deposition of the plating coating, a ground plating may be performed in advance using nickel-based plating, copper type plating or the like as the ground treatment of the plating of the first layer and/or the second layer coating film. In particular, when a stainless steel material is used as the blade base material, it is effective to perform nickel-based strike plating as the ground plating prior to the plating of the first layer.

As described above, the surface treated doctor blade of the present invention is coated with the above-described specific surface treatment coating of a double-layered structure, whereby it is possible to obtain the effect of the present invention (property for continuous printing (wear resistance) and ink scraping property).

Further, by exposing the doctor blade base material at the blade edge end portion, conformability between the cylinder and the blade edge end is improved, thereby shortening running-in time.

Figure 3:
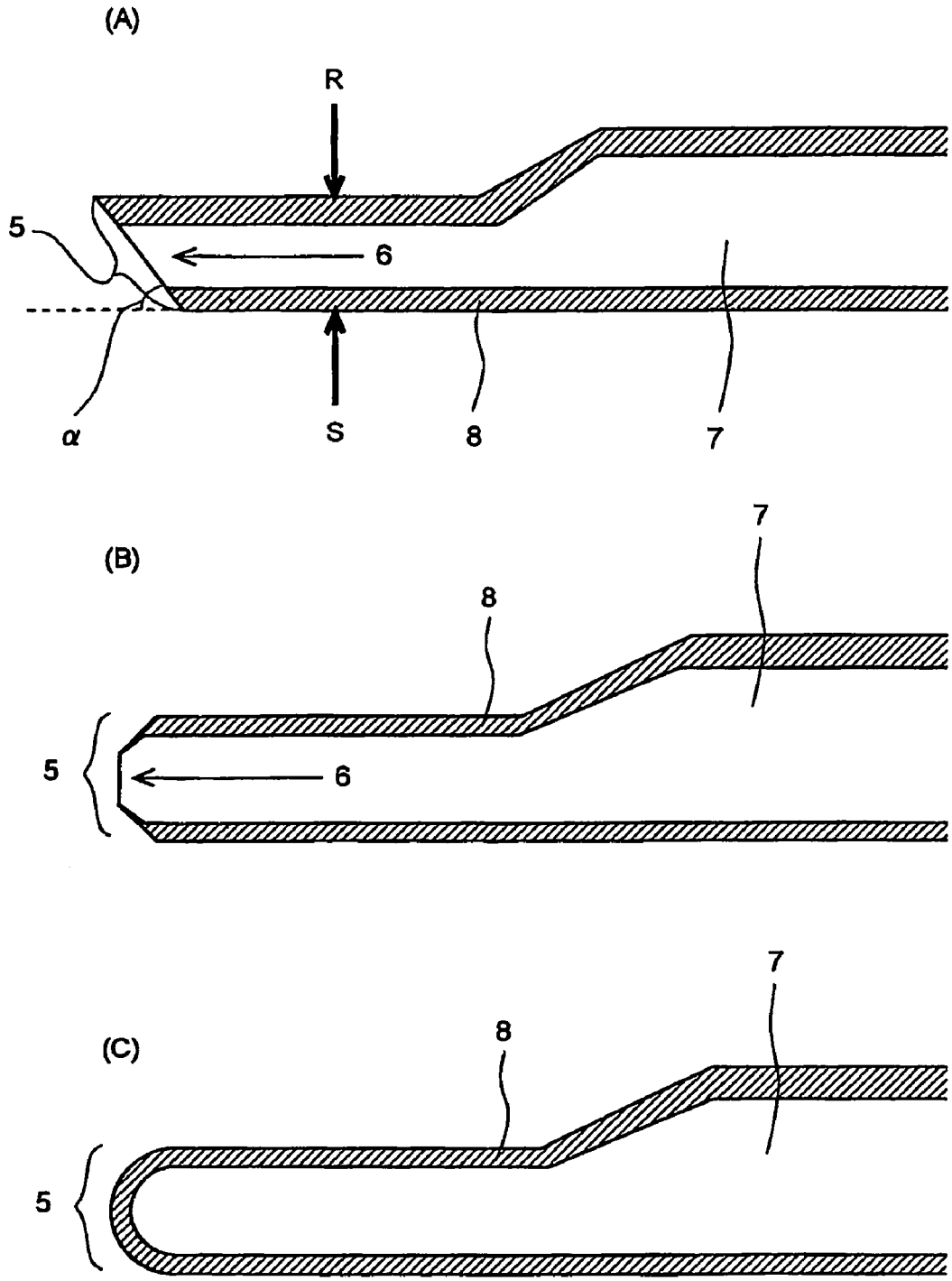
FIGS. 3(A) and 3(B) are sectional views showing a blade edge portion of the blade of the present invention with its base material being exposed at the edge (tip) end.
FIG. 3(C) is a sectional view showing a blade edge portion of the blade of the present invention with its base material of the edge end portion not being exposed.

Regarding the exposure of the base material at the blade edge portion, it is only necessary for at least a part of the blade base material at the blade edge end portion to be exposed. For example, the exposure can be effected as shown in the sectional views of FIGS. 3(A) and 3 (B), illustrating the blade edge end portion (5). In the case in which blade edge end conformability is more important than property for continuous printing, the mode as shown in FIG. 3(A) may be suitably adopted, in which the blade edge end is formed so as to exhibit a specific angle (e.g., blade edge end angle $\alpha$: 10° to 70°), with the blade base material (7) being exposed. In the case in which property for continuous printing is more important than conformability of the blade edge end, the mode as shown in FIG. 3(B) may be suitably adopted, in which the blade base material is exposed exclusively at the forwardmost end of the blade edge. In this way, regarding the exposure of the blade base material of the blade edge end, the way the blade base material is exposed can be suitably adjusted according to the printing system and the performance required.

Further, the blade edge portion other than the portion (6) where blade base material is exposed is characteristically coated with a surface treatment coating (8) having a specific double-layered structure. That is, it has to be coated with a surface treatment coating composed of a first layer consisting of a specific nickel-based plating or chromium-based plating and a second layer provided thereon and consisting of a low surface energy coating. With any other surface treatment coating, it is impossible to obtain a surface treated doctor blade which is superior in blade edge end conformability, ink scraping property, and property for continuous printing (wear resistance).

A blade whose base material is exposed at least partially at the blade edge end portion can be produced, for example, by the following sequence of steps: "sealing of the blade edge end portion of the blade base material with a masking agent", "surface treatment", "peeling of the masking agent", "annealing", "shearing in a predetermined size", "surface treatment", "polishing of exclusively the blade edge end portion with buff, abrasive paper or the like", "annealing", and "shearing in a predetermined size", or by the following sequence of steps: "surface treatment", "polishing of exclusively the blade edge end portion with buff, abrasive paper or the like", "annealing", "polishing of exclusively the blade edge end portion with buff, abrasive paper or the like", and "shearing in a predetermined size". Further, as a post-treatment, it is possible to perform surface polishing, anti-corrosive oil application, etc.

The embodiments of the present invention do not limit treatments performed on portions other than the blade edge end portion in accordance with the present invention. For example, the following embodiments of the surface treated doctor blade can be adopted without involving any problem:

(1) an embodiment in which double-layered coating according to the present invention is performed on the entire surface of a blade on both sides thereof (i.e., on the front side (S-side in FIG. 2) and the back side (R-side in FIG. 2) with respect to the cylinder rotating direction);

(2) an embodiment in which double-layered coating according to the present invention is performed on the entire surface of a blade on one side thereof; specifically, double-layered coating according to the present invention is performed on the front side of the blade edge end (S-side in FIG. 2), and the back side of the blade edge end (R-side in FIG. 2) is subjected to nickel-based plating or chromium-based plating or left without being plated with its steel surface exposed;

(3) an embodiment in which double-layered coating according to the present invention is performed at least on the blade edge on both sides thereof (S-side and R-side in FIG. 2); and (4) an embodiment in which double-layered coating according to the present invention is performed at least on one side of the blade edge; specifically, the front side (S-side in FIG. 2) of the blade edge end is subjected to double-layered coating according to the present invention, and the back side (R-side in FIG. 2) of the blade edge end is subjected to nickel-based plating or chromium-based plating or left without being plated with its steel surface exposed.

Further, in all of the above modes (1) to (4), the base material of a doctor blade at least at the blade edge end portion thereof may be exposed in order to improve conformability of the blade edge end.

The surface treated doctor blade of the present invention is applicable to printing such as gravure printing. Further, it can also be appropriately applied to other uses, such as painting, coating or removal of residual toner in an image forming apparatus. The ink or paint used in printing or painting may be a water-based or oil-based one. Further, in the present invention, there is no limitation regarding the inking system of the printing machine as long as it is a system using a blade; it may be, for example, a dip brazing system or a furnisher roller system.

BEST MODES FOR CARRYING OUT THE INVENTION

The present invention will now be described with reference to examples and comparative examples, which should not be construed restrictively.

In the examples and comparative examples, the degree of surface hardness, coating film thickness, and surface energy of the surface treated doctor blade were measured by the following methods.

Surface Hardness (Vickers Hardness)

5-point measurement was performed under the following conditions, and the average value thereby obtained was regarded as the Vickers hardness (Hv).

Figure 2:
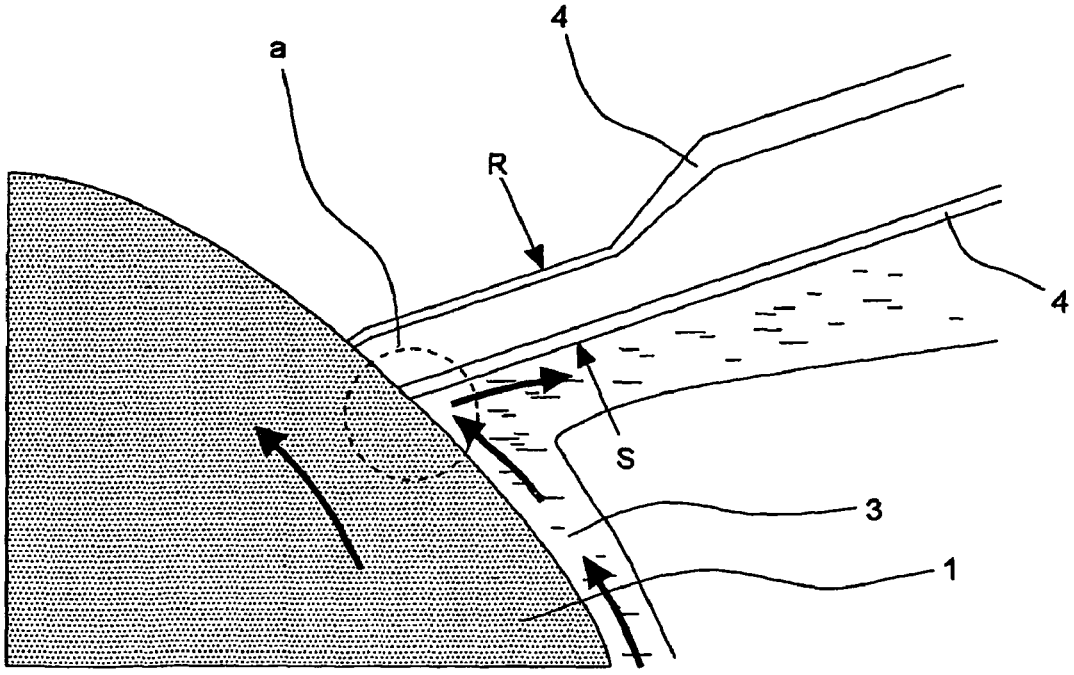
FIG. 2 is a partial enlarged view of FIG. 1.

Measurement position: the front side (with respect to the roll rotating direction, i.e., S-side in FIG. 2) of the blade edge end portion;

Measuring apparatus: HMV-2000 manufactured by Shimadzu Corporation;

Measurement condition: a test load of 25 gf and a retention time of 10 seconds.

Film Thickness

The section of the blade edge was observed by an electronic microscope to measure the film thickness of each layer.

Surface Energy

A drop of water was put on the surface of the surface treated portion of the blade edge, and the contact angle made by the drop of water and the surface (the water contact angle) was measured, and compared with the water contact angle in a blade with an SiC dispersed nickel-phosphorus composite single-layer plating described below (Comparative Example 1), utilizing the comparison result as a yardstick for surface energy.

High surface energy: The contact angle is the same as or smaller than that in the blade with the SiC dispersed nickel-phosphorus composite single-layer plating (Comparative Example 1).

Low surface energy: The contact angle is the same as or larger than that in the blade with the SiC dispersed nickel-phosphorus composite single-layer plating (Comparative Example 1).

EXAMPLE 1

Plating Process 1;

A single-and-parallel-edged steel base material for doctor blade (steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed for 15 minutes in an alkali degreasing solution (Pakuna RT-T (manufactured by Yuken Industry Co., Ltd.), 60 g/L) of 50° C. After being washed in water, it was subjected to a hydrochloric acid activation treatment in a hydrochloric acid activation liquid for 15 minutes, and was then further washed in water. Thereafter, it was immersed in an electroless Ni plating solution in which SiC particles having an average particle size of 0.5 μm were dispersed (plating solution manufactured by Japan Kanigen Co., Ltd.; Sumer SC-80-1: 20 vol %, Sumer SC-80-4; 2 vol %) at 87° C. until a predetermined plating thickness was attained to effect ceramic dispersed nickel-phosphorus composite plating containing SiC. After being washed in water, the specimen was dried. Thereafter, the spacer and the blade were unwound and separated to obtain a blade 1 having an SiC-particle-containing nickel-phosphorus-based composite (Ni—P—SiC) single layer plating.

Surface Adjustment Process;

Buff polishing was performed on the above-mentioned single-layer-plated blade 1 to completely remove the plating residues or the like from the surface, thereby obtaining a smooth, single-layer-plated blade 2.

Plating Process 2;

The single-layer-plated blade 2 was again spirally taken up on the reel together with the spacer consisting of a metal steel strip which had the surface roughened by embossing treatment, and in the state in which it was wound around the reel, it was immersed for 5 minutes in an alkali degreasing solution (Pakuna RT-T (manufactured by Yuken Industry Co., Ltd.) 50 g/L) of 50° C. After being washed in water, the specimen was subjected to hydrochloric acid activation treatment in a hydrochloric acid activation solution for 3 minutes, and was further washed in water. Thereafter, the specimen was immersed in an electroless Ni plating solution in which tetrafluoroethylene resin (1) was dispersed (a plating solution manufactured by Japan Kanigen Co., Ltd. (Kaniflon-0: 20 vol %, Kaniflon-4A (a solution in which tetrafluoroethylene resin (1) is dispersed): 2 vol %, pH 5) at 86° C. until a predetermined plating thickness was attained to effect an organic resin dispersed nickel-phosphorus composite plating containing tetrafluoroethylene resin, and then the specimen was washed in water and dried. Thereafter, the spacer and the blade were unwound and separated to obtain a double-layer-plated blade 1 having a first layer consisting of Ni—P—SiC plating and a second layer provided thereon and consisting of a nickel-phosphorus-based composite plating layer (Ni—P-PTFE (1)) containing particles of tetrafluoroethylene resin (1).

Post-Treatment Process;

Annealing was performed on the above-described blade 1 having double-layered plating at 300° C. for an hour, and then the blade was sheared in a predetermined size. The Vickers hardness (Hv), plating thickness, and surface energy of this surface treated doctor blade were measured. Table 1 collectively shows the values of the thickness (A) of the first layer, the thickness (B) of the second layer, the total thickness (A+B), the thickness ratio (B/A), the tetrafluoroethylene resin content in the second layer, the ratio of the particle size of the tetrafluoroethylene resin with respect to the thickness (B) of the second layer, the surface energy of the second layer, and the Vickers hardness (Hv).

(1) Continuous Printing Property (Wear Resistance)

After adjustment of conformability of the blade edge end, printing was performed by a printing machine in which the blade of Example 1 was mounted, using an oil-based ink and a water-based ink. The point in time when a printing failure such as a streak, fog, blurring, or bleeding was generated in the print was determined as the end of its service life of the blade. The amount of prints obtained until the blade reached the end of the service life was measured, and compared with the amount of prints obtained in the case of a blade with an SiC dispersed nickel-phosphorus composite single-layer plating (Comparative Example 1). Evaluation was made according to the following criteria.

| | With water-based ink | With oil-based ink |
|---|---|---|
| ◎ | 1 | 1 |
| ○ | 2 | 1 |
| Δ | 3 | 2 to 3 |
| X | 4 | 4 |

Evaluation Criteria

1: The amount of prints is much larger than that in the case where the blade having the SiC dispersed nickel-phosphorus composite single-layer plating was used(Comparative Example 1).

2: The amount of prints is a little larger than that in the case where the blade having the SiC dispersed nickel-phosphorus composite single-layer plating was used (Comparative Example 1).

3: The amount of prints is equal to that in the case where the blade having the SiC dispersed nickel-phosphorus composite single-layer plating was used (Comparative Example 1).

4: The amount of prints is smaller than that in the case where the blade having the SiC dispersed nickel-phosphorus composite single-layer plating was used (Comparative Example 1).

(2) Ink Scraping Property

Using a water-based ink, printing was performed with a gravure printing machine in which the blade of Example 1 was mounted. The printing speed in printing was gradually changed, and the printing speed at which an ink scraping failure (fog or the like) started to be generated was measured. The measured printing speed was regarded as the printing speed limit, which was evaluated by the following criteria, in comparison with that in the case where a steel product with no plating was used:

◎: The printing speed limit is not less than 1.4 times that in the case of the steel product.

○: The printing speed limit is not less than 1.1 times and less than 1.4 times that in the case of the steel product.

Δ: The printing speed limit is not less than 1.0 times and less than 1.1 times that in the case of the steel product.

X: The printing speed limit is less than 1.0 times that in the case of the steel product.

(3) Coating Adhesion

A surface treated doctor blade was bent at a predetermined angle according to JIS H 8504, a tape peel test was then conducted on the bent portion, and it was visually observed whether or not the coating film is peeled off. Evaluation was made according to the following criteria:

◎: Satisfactory (no coating film was peeled off)

Δ: A little defective (a small amount of the coating film was peeled off)

X: Defective (a large amount of the coating film was peeled off)

Table 1 collectively shows the evaluation results regarding property for continuous printing (wear resistance), ink scraping property, and coating film adhesion.

EXAMPLE 2

Plating Process;

A single-and-parallel-edged steel base material for doctor blade (steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a rough wire mesh, and in the state in which it was wound around the reel, it was immersed for 15 minutes in an alkali degreasing solution (Pakuna RT-T (manufactured by Yuken Industry Co., Ltd.), 60 g/l) of 50° C. After being washed in water, it was subjected to a hydrochloric acid activation treatment in a hydrochloric acid activation liquid for 15 minutes, and was then further washed in water. Thereafter, it was immersed in an electroless Ni plating solution in which SiC of an average particle size of 0.5 μm were dispersed (plating solution manufactured by Japan Kanigen Co., Ltd.; Sumer SC-80-1: 20 vol %, Sumer SC-80-4; 2 vol %) at 87° C. until a predetermined plating thickness was attained to effect ceramic dispersed nickel-phosphorus composite plating containing SiC (Ni—P—SiC). After being washed in water, it was further immersed in an electroless Ni plating solution in which tetrafluoroethylene resin (1) was dispersed (a plating solution manufactured by Japan Kanigen Co., Ltd. ((Kaniflon-0: 20 vol %, Kaniflon-4A (a liquid in which tetrafluoroethylene resin (1) is dispersed): 2 vol %, pH 5) at 86° C. until a predetermined plating thickness was attained to effect an organic resin dispersed nickel-phosphorus composite plating containing tetrafluoroethylene resin. After being washed in water, the specimen was dried. Thereafter, the spacer and the blade were unwound and separated to obtain a double-layer-plated blade 1 having a first layer consisting of Ni—P—SiC plating and a second layer provided thereon and consisting of a nickel-phosphorus-based composite plating layer (Ni—P-PTFE (1)) containing particles of tetrafluoroethylene resin (1).

Surface Adjustment Process;

Buff polishing was performed on the above-mentioned double-layer-plated blade 1 to completely remove the plating residues or the like from the surface, thereby obtaining a smooth, double-layer-plated blade 2.

Post-Treatment Process;

The above double-layer-plated blade 2 was subjected to annealing at 300° C. for an hour, and then sheared in a predetermined size. Table 1 shows the measurement and evaluation results regarding the Vickers hardness (Hv), plating thickness, surface energy of the second layer, property for continuous printing, ink scraping property, plating adhesion, etc. obtained in the same manner as in Example 1.

COMPARATIVE EXAMPLE 1

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/L) of 50° C. for 15 minutes. After being washed in water, the specimen was subjected to hydrochloric acid activation treatment in a hydrochloric acid activation solution for 15 minutes and further washed in water. Thereafter, the specimen was immersed in an electroless Ni plating solution in which SiC of an average particle size of 0.5 μm was dispersed (a plating solution manufactured by Japan Kanigen Co., Ltd.; SC-80-1: 20 vol %, SC-80-4: 2 vol %; pH 4.7) at 87° C. until a predetermined plating thickness was attained to effect ceramic dispersed nickel-phosphorus composite plating containing SiC. After being washed in water, the specimen was dried. Thereafter, the spacer and the blade were unwound and separated to thereby obtain a blade 1 plated with an SiC particle-containing nickel-phosphorus-based composite (Ni—P—SiC) single layer plating.

Surface Adjustment Process;

Buff polishing was performed on the above-mentioned single-layer-plated blade 1 to completely remove the plating residues or the like from the surface, thereby obtaining a smooth, single-layer-plated blade 2.

Post-Treatment Process;

The above single-layer-plated blade 2 was subjected to annealing at 300° C. for an hour, and then sheared in a predetermined size. Table 1 shows the measurement and evaluation results regarding the Vickers hardness (Hv), plating thickness, property for continuous printing, ink scraping property, plating adhesion, etc. obtained in the same manner as in Example 1.

COMPARATIVE EXAMPLE 2

Plating Process;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/L) of 50° C. for 15 minutes. After being washed in water, the specimen was subjected to hydrochloric acid activation treatment in a hydrochloric acid activation solution for 15 minutes and further washed in water. Thereafter, the specimen was immersed in an electroless Ni plating solution in which tetrafluoroethylene resin wass dispersed (a plating solution manufactured by Japan Kanigen Co., Ltd. ((Kaniflon-0: 20 vol %, Kaniflon-4A (a solution in which tetrafluoroethylene resin (1) is dispersed): 2 vol %, pH 5) at 86° C. until a predetermined plating thickness was attained to effect an organic resin dispersed nickel-phosphorus composite plating containing tetrafluoroethylene resin. After being washed in water, the specimen was dried. Thereafter, the spacer and the blade were unwound and separated to thereby obtain a blade 1 plated with a single layer of a tetrafluoroethylene resin (1)-particle-containing nickel-phosphorus-based composite plating (Ni—P-PTFE (1)).

Surface Adjustment Process;

Buff polishing was performed on the above-mentioned single-layer-plated blade 1 to completely remove the plating residues or the like from the surface, thereby obtaining a single-layer-plated blade 2.

Post-Treatment Process;

The above single-layer-plated blade 2 was subjected to annealing at 300° C. for an hour, and then sheared in a predetermined size. Table 1 shows the measurement and evaluation results regarding the Vickers hardness (Hv), plating thickness, property for continuous printing, ink scraping property, plating adhesion, etc. obtained in the same manner as in Example 1.

COMPARATIVE EXAMPLES 3 and 4 and EXAMPLES 3 to 33

As in Example 1, a single-and-parallel-edged steel base material for doctor blade (steel strip having a total length of 50 m) having a plate width of 50 mm, a plate thickness of 0.15 mm, a blade edge width of 1.4 mm, and a blade edge end thickness of 0.07 mm was appropriately subjected to a pre-treatment, and then various plating processes were performed thereon to prepare the surface treated doctor blades of Comparative Examples 3 and 4 and Examples 3 to 33 as shown in Table 1. Table 1 shows the measurement and evaluation results obtained in the same manner as in Example 1 regarding the Vickers hardness (Hv), plating thickness, surface energy, property for continuous printing, ink scraping property, and plating adhesion of these surface treated doctor blades. Table 2 shows the average particle sizes of eight types of tetrafluoroethylene resin particles (PTFE (1) to PTFE (8)) dispersed in the plating. The average particle size of the SiC particles used was 0.5 μm.

EXAMPLE 34

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was continuously subjected to electrolysis (Pakuna Erekuta J (manufactured by Yuken Industry Co., Ltd.): 50 m/l, NaOH: 50 g/l, 30° C., 2.5 A) and washed in water. Thereafter, electric chromium plating (chromic anhydride: 250 g/l, $H_2SO_4$: 2.5 g/L, HEEF25C: 20 ml/l, bath temperature: 50° C.) was performed on the specimen, adjusting the plating current and plating time so as to attain a predetermined plating thickness, to thereby prepare a single-layer chromium-plated blade 1.

Surface Adjustment Process;

Buff polishing was performed on the above-mentioned single-layer chromium-plated blade 1 to completely remove the plating residues or the like from the surface, thereby obtaining a single-layer chromium-plated blade 2.

Plating Process 2;

The single-layer chromium-plated blade 2 was again spirally taken up on the reel together with the spacer consisting of a metal steel strip which had the surface roughened by embossing treatment, and in the state in which it was wound around the reel, it was immersed for 5 minutes in an alkali degreasing solution (Pakuna RT-T (manufactured by Yuken Industry Co., Ltd.) 50 g/L) of 50° C. After being washed in water, the specimen was subjected to hydrochloric acid activation treatment in a hydrochloric acid activation solution for 3 minutes, and was further washed in water. Thereafter, the specimen was immersed in an electroless Ni plating solution in which tetrafluoroethylene resin (1) was dispersed (a plating solution manufactured by Japan Kanigen Co., Ltd. (Kaniflon-0: 20 vol %, Kaniflon-4A (a solution in which tetrafluoroethylene resin (1) is dispersed): 2 vol %, pH: 5) at 86° C. until a predetermined plating thickness was attained to effect an organic resin dispersed nickel-phosphorus composite plating containing tetrafluoroethylene resin, and then the specimen was washed in water and dried. Thereafter, the spacer and the blade were unwound and separated to obtain a double-layer-plated blade 1 having a first layer consisting of chromium (Cr) plating and a second layer provided thereon and consisting of a nickel-phosphorus-based composite plating layer (Ni—P-PTFE (1)) containing particles of tetrafluoroethylene resin (1).

Post-Treatment Process;

The above double-layer-plated blade 1 was subjected to annealing at 300° C. for an hour, and then sheared in a predetermined size. Table 1 shows the measurement and evaluation results regarding the Vickers hardness (Hv), plating thickness, surface energy of the second layer, property for continuous printing, ink scraping property, plating adhesion, etc. obtained in the same manner as in Example 1.

TABLE 1

Surface treated doctor blade and properties

| | | First layer | | Second layer | | | | PTFE |
|---|---|---|---|---|---|---|---|---|
| | No. | Type | Film thickness (A) (μm) | Type | PTFE content (vol %) | Film thickness (B) (μm) | Surface energy | grain size/ film thickness (B) |
| Example | 1 | Ni—P—SiC | 6 | Ni—P-PTFE(1) | 20 to 25 | 1 | Low | 0.22 |
| | 2 | Ni—P—SiC | 7 | Ni—P-PTFE(1) | 20 to 25 | 1 | Low | 0.22 |
| | 3 | Ni—P—SiC | 6 | Ni—P-PTFE(1) | 3 to 7 | 1 | Low | 0.22 |
| | 4 | Ni—P—SiC | 6 | Ni—P-PTFE(1) | 10 to 15 | 1 | Low | 0.22 |
| | 5 | Ni—P—SiC | 6 | Ni—P-PTFE(1) | 30 to 35 | 1 | Low | 0.22 |

TABLE 1-continued

| Surface treated doctor blade and properties | | | | | | | | |
|---|---|---|---|---|---|---|---|---|
| | 6 | Ni—P—SiC | 6 | Ni—P-PTFE(1) | 45 to 50 | 1 | Low | 0.22 |
| | 7 | Ni—P—SiC | 6 | Ni—P-PTFE(2) | 20 to 25 | 1 | Low | 0.06 |
| | 8 | Ni—P—SiC | 6 | Ni—P-PTFE(3) | 20 to 25 | 1 | Low | 0.12 |
| | 9 | Ni—P—SiC | 6 | Ni—P-PTFE(4) | 20 to 25 | 1 | Low | 0.15 |
| | 10 | Ni—P—SiC | 6 | Ni—P-PTFE(5) | 20 to 25 | 1 | Low | 0.35 |
| | 11 | Ni—P—SiC | 7 | Ni—P-PTFE(6) | 20 to 25 | 2 | Low | 0.35 |
| | 12 | Ni—P—SiC | 7 | Ni—P-PTFE(7) | 20 to 25 | 2 | Low | 0.75 |
| | 13 | Ni—P—SiC | 7 | Ni—P-PTFE(8) | 20 to 25 | 2 | Low | 3.0 |
| | 14 | Ni—P—SiC | 4.5 | Ni—P-PTFE(5) | 20 to 25 | 0.5 | Low | 0.7 |
| | 15 | Ni—P—SiC | 6 | Ni—P-PTFE(1) | 20 to 25 | 1 | Low | 0.22 |
| | 16 | Ni—P—SiC | 6 | Ni—P-PTFE(1) | 20 to 25 | 1 | Low | 0.22 |
| | 17 | Ni—P—SiC | 6 | Ni—P-PTFE(1) | 20 to 25 | 1 | Low | 0.22 |
| | 18 | Ni—P—SiC | 6 | Ni—P-PTFE(1) | 20 to 25 | 1 | Low | 0.22 |
| | 19 | Ni—P—SiC | 6 | Ni—P-PTFE(1) | 20 to 25 | 1 | Low | 0.22 |
| | 20 | Ni—P—SiC | 6 | Ni—P-PTFE(1) | 20 to 25 | 1 | Low | 0.22 |
| | 21 | Ni—P—SiC | 6 | Ni—P-PTFE(1) | 20 to 25 | 1 | Low | 0.22 |
| | 22 | Ni—P—SiC | 2.1 | Ni—P-PTFE(1) | 20 to 25 | 0.4 | Low | 0.38 |
| | 23 | Ni—P—SiC | 3.3 | Ni—P-PTFE(1) | 20 to 25 | 0.7 | Low | 0.31 |
| | 24 | Ni—P—SiC | 5 | Ni—P-PTFE(1) | 20 to 25 | 1 | Low | 0.22 |
| | 25 | Ni—P—SiC | 10 | Ni—P-PTFE(1) | 20 to 25 | 2 | Low | 0.11 |
| | 26 | Ni—P—SiC | 16 | Ni—P-PTFE(1) | 20 to 25 | 4 | Low | 0.06 |
| | 27 | Ni—P—SiC | 21 | Ni—P-PTFE(1) | 20 to 25 | 4 | Low | 0.06 |
| | 28 | Ni—P—SiC | 7.7 | Ni—P-PTFE(4) | 20 to 25 | 0.3 | Low | 0.50 |
| | 29 | Ni—P—SiC | 7.5 | Ni—P-PTFE(1) | 20 to 25 | 0.5 | Low | 0.42 |
| | 30 | Ni—P—SiC | 7.1 | Ni—P-PTFE(1) | 20 to 25 | 0.9 | Low | 0.26 |
| | 31 | Ni—P—SiC | 6.2 | Ni—P-PTFE(1) | 20 to 25 | 1.8 | Low | 0.12 |
| | 32 | Ni—P—SiC | 5.3 | Ni—P-PTFE(1) | 20 to 25 | 2.7 | Low | 0.08 |
| | 33 | Ni—P—SiC | 3.6 | Ni—P-PTFE(1) | 20 to 25 | 4.4 | Low | 0.05 |
| | 34 | Cr | 6 | Ni—P-PTFE(1) | 20 to 25 | 1 | Low | 0.22 |
| Comparative Example | 1 | Ni—P—SiC | 8 | — | | — | — | — |
| | 2 | Ni—P-PTFE(1)*1 | 7 | — | | — | — | — |
| | 3 | Ni—P-PTFE(1)*1 | 6 | Ni—P—SiC | | 1 | High | — |
| | 4 | Ni—P—SiC | 6 | Ni—P | 0 | 1 | High | — |

| | No. | Total film thickness (A + B) | Film thickness ratio (B/A) | Hardness (Hv) | Continuous printing characteristic | Ink scraping property | Coating adhesion |
|---|---|---|---|---|---|---|---|
| Example | 1 | 7 | 0.17 | 1000 | ◎ | ◎ | ○ |
| | 2 | 8 | 0.14 | 1000 | ◎ | ◎ | ○ |
| | 3 | 7 | 0.17 | 1000 | ○ | ○ | ○ |
| | 4 | 7 | 0.17 | 1000 | ◎ | ○ | ○ |
| | 5 | 7 | 0.17 | 1000 | ○ | ◎ | ○ |
| | 6 | 7 | 0.17 | 1000 | ○ | ○ | Δ |
| | 7 | 7 | 0.17 | 1000 | Δ | ◎ | Δ |
| | 8 | 7 | 0.17 | 1000 | ○ | ◎ | ○ |
| | 9 | 7 | 0.17 | 1000 | ◎ | ◎ | ○ |
| | 10 | 7 | 0.17 | 1000 | ◎ | ◎ | ○ |
| | 11 | 9 | 0.29 | 1000 | ◎ | ○ | ○ |
| | 12 | 9 | 0.29 | 1000 | ○ | ○ | ○ |
| | 13 | 9 | 0.29 | 1000 | Δ | ◎ | Δ |
| | 14 | 5 | 0.11 | 1000 | ○ | ◎ | Δ |
| | 15 | 7 | 0.17 | 500 | Δ | ○ | ○ |
| | 16 | 7 | 0.17 | 750 | ○ | ◎ | ○ |
| | 17 | 7 | 0.17 | 850 | ◎ | ◎ | ○ |
| | 18 | 7 | 0.17 | 900 | ◎ | ◎ | ○ |
| | 19 | 7 | 0.17 | 1100 | ◎ | ◎ | ○ |
| | 20 | 7 | 0.17 | 1200 | ○ | ◎ | ○ |
| | 21 | 7 | 0.17 | 1350 | Δ | ○ | Δ |
| | 22 | 2.5 | 0.19 | 720 | Δ | ◎ | ◎ |
| | 23 | 4 | 0.21 | 900 | ○ | ◎ | ○ |
| | 24 | 6 | 0.20 | 1000 | ◎ | ◎ | ○ |
| | 25 | 12 | 0.20 | 1000 | ○ | ◎ | ○ |
| | 26 | 20 | 0.25 | 1000 | ○ | ◎ | Δ |
| | 27 | 25 | 0.19 | 1000 | Δ | ○ | Δ |
| | 28 | 8 | 0.04 | 1100 | ○ | Δ | ○ |
| | 29 | 8 | 0.07 | 1100 | ◎ | ○ | ○ |
| | 30 | 8 | 0.12 | 1000 | ◎ | ◎ | ○ |
| | 31 | 8 | 0.29 | 1000 | ◎ | ◎ | ○ |
| | 32 | 8 | 0.50 | 900 | ○ | ◎ | ○ |
| | 33 | 8 | 1.22 | 750 | Δ | ○ | ○ |
| | 34 | 7 | 0.17 | 900 | ○ | ◎ | ○ |

TABLE 1-continued

| Surface treated doctor blade and properties | | | | | | | |
|---|---|---|---|---|---|---|---|
| Comparative Example | 1 | 8 | — | 1000 | Δ | X | ○ |
| | 2 | 7 | — | 500 | X | X | ○ |
| | 3 | 7 | 0.17 | 900 | X | X | X |
| | 4 | 7 | 0.17 | 900 | Δ | X | ○ |

*[1]PTFE content is 20 to 25 vol %

TABLE 2

| Particle size of PTFE | |
|---|---|
| | Particle size (μm) |
| PTFE(1) | 0.22 |
| PTFE(2) | 0.06 |
| PTFE(3) | 0.12 |
| PTFE(4) | 0.15 |
| PTFE(5) | 0.35 |
| PTFE(6) | 0.7 |
| PTFE(7) | 1.5 |
| PTFE(8) | 6 |

EXAMPLE 35

Plating Process;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, the specimen was immersed for 15 minutes in an alkali degreasing solution (Pakuna RT-T (manufactured by Yuken Industry Co., Ltd.); 60 g/liter) of 50° C. After being washed in water, the specimen was subjected to hydrochloric acid activation treatment in a hydrochloric acid activation solution for 15 minutes, and was further washed in water. Thereafter, the specimen was immersed in an electroless Ni plating solution in which SiC particles with an average particle size of 0.5 μm were dispersed (a plating solution manufactured by Japan Kanigen Co., Ltd., Sumer SC-80-1: 20 vol %, Sumer SC-80-4: 2 vol %) at 87° C. until a predetermined plating thickness was attained to thereby effect a ceramic dispersed nickel-phosphorus composite plating containing SiC particles. After being washed in water, the specimen was dried. Thereafter, the spacer and the blade were unwound and separated to thereby obtain a blade 1 with an SiC particle dispersed nickel-phosphorus-based composite (Ni—P—SiC) single layer plating.

Surface Adjustment Process;

Buff polishing was performed on the above-mentioned single-layer-plated blade 1 to completely remove the plating residues or the like from the surface. After performing annealing at 300° C. for an hour, there was obtained a single-layer-plated blade 2.

Coating Process;

An acrylic resin coating material containing tetrafluoroethylene resin (5) (PTFE (5)) was applied to the single-layer-plated blade 2 by using a roll coater such that the film thickness when dried was 1 μm, and then dried in a hot-air drying furnace. Thereafter, the specimen was sheared in a predetermined size to thereby obtain a double-layered surface treated doctor blade according to the present invention. The Vickers hardness (Hv), film thickness of each layer, and surface energy of this surface treated doctor blade were measured. Further, property for continuous printing, ink scraping property, and coating film adhesion of this surface treated doctor blade were evaluated in the same manner as in Example 1.

Table 3 shows the results of measurement and evaluation of the thickness (A) of the first layer, second layer thickness (B), total layer thickness (A+B), layer thickness ratio (B/A), the mount of tetrafluoroethylene resin contained in the second layer, Vickers hardness (Hv), surface energy of the second layer, property for continuous printing, ink scraping property, coating film adhesion, etc. Table 4 shows the particle size of the PTFE (5) particles dispersed in the coating layer.

COMPARATIVE EXAMPLE 5

Plating Process;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, the specimen was immersed for 15 minutes in an alkali degreasing solution (Pakuna RT-T (manufactured by Yuken Industry Co., Ltd.); 60 g/l) of 50° C. After being washed in water, the specimen was subjected to hydrochloric acid activation treatment in a hydrochloric acid activation solution for 15 minutes, and was further washed in water. Thereafter, the specimen was immersed in an electroless Ni plating solution in which SiC particles with an average particle size of 0.5 μm are dispersed (a plating solution manufactured by Japan Kanigen Co., Ltd., Sumer SC-80-1: 20 vol %, Sumer SC-80-4: 2 vol %, pH 4.7) at 87° C. until a predetermined plating thickness was attained to thereby effect a ceramic dispersed nickel-phosphorus composite plating containing SiC particles. After being washed in water, the specimen was dried. Thereafter, the spacer and the blade were unwound and separated to thereby obtain a blade 1 plated with an SiC particle-containing nickel-phosphorus-based composite (Ni—P—SiC) single layer plating.

Surface Adjustment Process;

Buff polishing was performed on the above-mentioned single-layer-plated blade 1 to completely remove the plating residues or the like from the surface, thereby obtaining a single-layer-plated blade 2.

Post-Treatment Process;

The above single-layer-plated blade 2 was subjected to annealing at 300° C. for an hour, and then sheared in a predetermined size.

Table 3 shows the measurement and evaluation results regarding the Vickers hardness (Hv), plating thickness, property for continuous printing, ink scraping property, and coating film adhesion obtained in the same manner as in Example 35.

COMPARATIVE EXAMPLE 6

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, the specimen was immersed for 15 minutes in an alkali degreasing solution (Pakuna RT-T (manufactured by Yuken Industry Co., Ltd.); 60 g/l) of 50° C. After being washed in water, the specimen was subjected to hydrochloric acid activation treatment in a hydrochloric acid activation solution for 15 minutes, and was further washed in water. Thereafter, the specimen was immersed in an electroless Ni plating solution in which tetrafluoroethylene resin (1) is dispersed (a plating solution manufactured by Japan Kanigen Co., Ltd., Kaniflon-0: 20 vol %, Kaniflon-4A (a liquid in which tetrafluoroethylene resin (1) is dispersed): 2 vol %, pH 5) at 86° C. until a predetermined plating thickness was attained to thereby effect an organic resin dispersed nickel-phosphorus composite plating containing tetrafluoroethylene resin. After being washed in water, the specimen was dried. Thereafter, the spacer and the blade were unwound and separated to thereby obtain a blade 1 plated with a single layer of a tetrafluoroethylene resin (1)-particle-containing nickel-phosphorus-based composite plating (Ni—P-PTFE (1)).

Surface Adjustment Process;

Buff polishing was performed on the above-mentioned single-layer-plated blade 1 to completely remove the plating residues or the like from the surface, thereby obtaining a single-layer-plated blade 2.

Post-Treatment Process;

The above single-layer-plated blade 2 was subjected to annealing at 300° C. for an hour, and then sheared in a predetermined size.

Table 3 shows the measurement and evaluation results regarding the Vickers hardness (Hv), plating thickness, property for continuous printing, ink scraping property, and coating film adhesion obtained in the same manner as in Example 35.

EXAMPLES 36 TO 64 AND COMPARATIVE EXAMPLES 7 AND 8

As in Example 35, a single-and-parallel-edged steel base material for doctor blade (steel strips having a total length of 50 m) having a plate width of 50 mm, a plate thickness of 0.15 mm, a blade edge width of 1.4 mm, and a blade edge end thickness of 0.07 mm were appropriately subjected to a pre-treatment, and then a ceramic dispersed nickel-phosphorus composite plating containing SiC particles (in Comparative Example 7, a tetrafluoroethylene resin particle-containing nickel-phosphorus composite plating) was performed thereon. Thereafter, surface treatment was appropriately performed on the specimens to thereby prepare the surface treated doctor blades of Examples 36 to 64 and Comparative Examples 7 and 8 as shown in Table 3. Table 3 shows the results of the measurement and evaluation, as in Example 35, of the Vickers hardness (Hv), layer thickness of each layer, surface energy of the second layer, property for continuous printing, ink scraping property, and coating film adhesion of these surface treated doctor blades. Table 4 shows the average particle sizes of the tetrafluoroethylene resin particles (PTFE (1) to PTFE (6)) used.

EXAMPLE 65

Plating Process;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was continuously subjected to electrolysis (Pakuna Erekuta J (manufactured by Yuken Industry Co., Ltd.): 5 vol %, NaOH: 50 g/l, 30° C., 2.5 A) and washed in water. Thereafter, electric chromium plating (chromic anhydride: 250 g/l, $H_2SO_4$: 2.5 g/L, HEEF25C: 20 ml/l, bath temperature: 50° C.) was performed on the specimen, adjusting the plating current and plating time so as to attain a predetermined plating thickness, to thereby prepare a single-layer chromium-plated blade 1.

Surface Adjustment Process;

Buff polishing was performed on the above-mentioned single-layer chromium-plated blade 1 to completely remove the plating residues or the like from the surface. After performing annealing at 300° C. for an hour, there was obtained a single-layer chromium-plated blade 2.

Coating Process;

An acrylic resin coating material containing tetrafluoroethylene resin (5) was applied to the single-layer chromium-plated blade 2 by using a roll coater such that the film thickness when dried was 1 μm, and then dried in a hot-air drying furnace. Thereafter, the specimen was sheared in a predetermined size to thereby obtain a blade having a double-layer structure according to the present invention.

The Vickers hardness (Hv), layer thickness of each layer, surface energy of the second layer, property for continuous printing, ink scraping property, and coating film adhesion of this surface treated doctor blade were evaluated in the same manner as in Example 35. Table 3 shows the results of measurement and evaluation.

COMPARATIVE EXAMPLE 9

Tetrafluoroethylene-based resin coating was applied to a single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm by using a roll coater such that the film thickness when dried was 7 μm, and then dried in a hot-air drying furnace. Thereafter, the specimen was sheared in a predetermined size.

The Vickers hardness (Hv), coating film thickness, property for continuous printing, ink scraping property, and coating film adhesion of this surface treated doctor blade were measured and evaluated in the same manner as in Example 35. Table 3 shows the results of measurement and evaluation.

TABLE 3

Surface treated doctor blade and quality performance

| | | First layer | | Second layer | | | |
|---|---|---|---|---|---|---|---|
| | No. | Type | Film thickness (A) | Coating film type | PTFE resin particle content (vol %) | Film thickness (B) | Surface energy |
| Example | 35 | Ni—P—SiC | 6 | Acrylic resin coating film containing PTFE(5) | 30 | 1 | Low |
| | 36 | Ni—P—SiC | 6 | PTFE-based coating film | — | 1 | Low |
| | 37 | Ni—P—SiC | 6 | Silicone resin-based coating film | — | 1 | Low |
| | 38 | Ni—P—SiC | 6 | Perfluoroalkoxy resin-based coating film | — | 1 | Low |
| | 39 | Ni—P—SiC | 6 | Fluorinated ethylene propylene resin-based coating film | — | 1 | Low |
| | 40 | Ni—P—SiC | 6 | Acrylic resin-based coating film | — | 1 | Low |
| | 41 | Ni—P—SiC | 6 | Epoxy resin coating film containing PTFE(5) | 30 | 1 | Low |
| | 42 | Ni—P—SiC | 6 | Acrylic resin coating film containing PTFE(2) | 30 | 1 | Low |
| | 43 | Ni—P—SiC | 6 | Acrylic resin coating film containing PTFE(3) | 30 | 1 | Low |
| | 44 | Ni—P—SiC | 6 | Acrylic resin coating film containing PTFE(4) | 30 | 1 | Low |
| | 45 | Ni—P—SiC | 6 | Acrylic resin coating film containing PTFE(6) | 30 | 1 | Low |
| | 46 | Ni—P—SiC | 6 | Acrylic resin coating film containing PTFE(7) | 30 | 1 | Low |
| | 47 | Ni—P—SiC | 6 | PTFE-based coating film | — | 1 | Low |
| | 48 | Ni—P—SiC | 6 | PTFE-based coating film | — | 1 | Low |
| | 49 | Ni—P—SiC | 6 | PTFE-based coating film | — | 1 | Low |
| | 50 | Ni—P—SiC | 6 | PTFE-based coating film | — | 1 | Low |
| | 51 | Ni—P—SiC | 6 | PTFE-based coating film | — | 1 | Low |
| | 52 | Ni—P—SiC | 6 | PTFE-based coating film | — | 1 | Low |
| | 53 | Ni—P—SiC | 1.6 | PTFE-based coating film | — | 0.4 | Low |
| | 54 | Ni—P—SiC | 3.3 | PTFE-based coating film | — | 0.7 | Low |
| | 55 | Ni—P—SiC | 5 | PTFE-based coating film | — | 1 | Low |

| | No. | Total film thickness | Film thickness ratio (B/A) | Hardness (Hv) | Continuous printing | Ink scraping property | Coating film adhesion |
|---|---|---|---|---|---|---|---|
| Example | 35 | 7 | 0.17 | 1000 | ◎ | ◎ | ○ |
| | 36 | 7 | 0.17 | 900 | ◎ | ◎ | ○ |
| | 37 | 7 | 0.17 | 1000 | ○ | ◎ | ○ |
| | 38 | 7 | 0.17 | 1000 | ◎ | ◎ | ○ |
| | 39 | 7 | 0.17 | 1000 | ◎ | ◎ | ○ |
| | 40 | 7 | 0.17 | 1000 | ○ | ○ | ○ |
| | 41 | 7 | 0.17 | 1000 | ◎ | ○ | ○ |
| | 42 | 7 | 0.17 | 1000 | ○ | ◎ | Δ |
| | 43 | 7 | 0.17 | 1000 | ○ | ◎ | ○ |
| | 44 | 7 | 0.17 | 1000 | ◎ | ◎ | ○ |
| | 45 | 7 | 0.17 | 1000 | ○ | ○ | ○ |
| | 46 | 7 | 0.17 | 1000 | Δ | ○ | ○ |
| | 47 | 7 | 0.17 | 600 | Δ | Δ | ○ |
| | 48 | 7 | 0.17 | 750 | ◎ | ○ | ○ |
| | 49 | 7 | 0.17 | 900 | ◎ | ◎ | ○ |
| | 50 | 7 | 0.17 | 1100 | ◎ | ◎ | ○ |
| | 51 | 7 | 0.17 | 1200 | ○ | ◎ | ○ |
| | 52 | 7 | 0.17 | 1400 | Δ | ○ | Δ |
| | 53 | 2 | 0.25 | 700 | Δ | ○ | ○ |
| | 54 | 4 | 0.21 | 900 | ○ | ◎ | ○ |
| | 55 | 6 | 0.20 | 1000 | ◎ | ◎ | ○ |

| | | First layer | | Second layer | | | |
|---|---|---|---|---|---|---|---|
| | No. | Type | Film thickness (A) (μm) | Coating film type | PTFE resin particle content (vol %) | Film thickness (B) (μm) | Surface energy |
| Example | 56 | Ni—P—SiC | 8 | PTFE-based coating film | — | 2 | Low |
| | 57 | Ni—P—SiC | 12 | PTFE-based coating film | — | 2 | Low |
| | 58 | Ni—P—SiC | 25 | PTFE-based coating film | — | 4 | Low |
| | 59 | Ni—P—SiC | 7.9 | PTFE-based coating film | — | 0.06 | Low |
| | 60 | Ni—P—SiC | 7.6 | PTFE-based coating film | — | 0.4 | Low |
| | 61 | Ni—P—SiC | 7.3 | PTFE-based coating film | — | 0.7 | Low |
| | 62 | Ni—P—SiC | 6.2 | PTFE-based coating film | — | 1.8 | Low |
| | 63 | Ni—P—SiC | 5 | PTFE-based coating film | — | 3 | Low |
| | 64 | Ni—P—SiC | 4 | PTFE-based coating film | — | 4 | Low |
| | 65 | Cr | 6 | Acrylic resin coating film containing | 30 | 1 | Low |

TABLE 3-continued

| Surface treated doctor blade and quality performance | | | | | | | |
|---|---|---|---|---|---|---|---|
| Comparative Example | 5 | Ni—P—SiC | 7 | — | — | — | — |
| | 6 | Ni—P*[1]-PTFE(1) | 8 | — | — | — | — |
| | 7 | Ni—P*[1]-PTFE(1) | 6 | Arcylic resin coating film containing PTFE(5) | 30 | 1 | Low |
| | 8 | Ni—P—SiC | 6 | Epoxy resin coating film (high surface energy coating film) | — | 1 | High |
| | 9 | PTFE-based | 7 | — coating film | — | — | — |

| No. | | Total film thickness (A + B) | Film thickness ratio (B/A) | Hardness (Hv) | Continuous printing | Ink scraping property | Coating film adhesion |
|---|---|---|---|---|---|---|---|
| Example | 56 | 10 | 0.25 | 1000 | ◎ | ◎ | ○ |
| | 57 | 14 | 0.17 | 1000 | ○ | ◎ | Δ |
| | 58 | 29 | 0.16 | 1000 | Δ | ○ | Δ |
| | 59 | 8 | 0.007 | 1100 | ○ | Δ | ○ |
| | 60 | 8 | 0.05 | 1100 | ○ | ○ | ○ |
| | 61 | 8 | 0.10 | 1000 | ◎ | ◎ | ○ |
| | 62 | 8 | 0.30 | 1000 | ◎ | ◎ | ○ |
| | 63 | 8 | 0.60 | 900 | ○ | ◎ | ○ |
| | 64 | 8 | 1.00 | 700 | ○ | ○ | ○ |
| | 65 | 7 | 0.17 | 900 | ○ | ◎ | ○ |
| Comparative Example | 5 | 7 | — | 1000 | Δ | x | ○ |
| | 6 | 8 | — | 700 | x | x | ○ |
| | 7 | 7 | 0.17 | 600 | x | x | Δ |
| | 8 | 7 | 0.17 | 1000 | x | x | ○ |
| | 9 | 7 | — | 600 | x | x | Δ |

*[1]PTFE content is 20 to 25 vol %

TABLE 4

| Particle size of PTFE | |
|---|---|
| | Particle size (μm) |
| PTFE(1) | 0.22 |
| PTFE(2) | 0.06 |
| PTFE(3) | 0.12 |
| PTFE(4) | 0.17 |
| PTFE(5) | 0.7 |
| PTFE(6) | 5 |
| PTFE(7) | 7 |

EXAMPLE 66

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/l) of 50° C. for 15 minutes. After being washed in water, the specimen was subjected to hydrochloric acid activation treatment in a hydrochloric acid activation solution for 15 minutes and further washed in water. Thereafter, the specimen was immersed in an electroless Ni plating solution in which SiC (3) particles of an average particle size of 0.5 μm were dispersed (a plating solution manufactured by Japan Kanigen Co., Ltd. (Sumer SC-80-1: 20 vol %, Sumer SC-80-4; 2 vol %) at 87° C. until a predetermined film thickness was attained to effect a nickel-phosphorus composite plating containing SiC. After being washed in water, the specimen was dried. Thereafter, the spacer and the blade were unwound and separated to thereby obtain a blade 1 plated with an SiC particle-containing nickel-phosphorus-based composite (Ni—P—SiC (3)) single layer plating.

Surface Adjustment Process;

Buff polishing was performed on the above-mentioned single-layer-plated blade 1 to completely remove the plating residues or the like from the surface, thereby obtaining a single-layer-plated blade 2.

Plating Process 2;

The single-layer-plated blade 2 was again spirally taken up on the reel together with the spacer consisting of a metal steel strip which had the surface roughened by embossing treatment, and in the state in which it was wound around the reel, it was immersed for 5 minutes in an alkali degreasing solution (Pakuna RT-T (manufactured by Yuken Industry Co., Ltd.) 50 g/l) of 50° C. After being washed in water, the specimen was subjected to hydrochloric acid activation treatment in a hydrochloric acid activation solution, and was further washed in water. Thereafter, the specimen was immersed in an electroless Ni plating solution in which tetrafluoroethylene resin (1) (PTFE(1)) (average particle size: 0.22 μm) is dispersed (a plating solution manufactured by Japan Kanigen Co., Ltd. (Kaniflon-0: 20 vol %, Kaniflon-4A (a solution in which tetrafluoroethylene resin (1) is dispersed): 2 vol %) at 86° C. until a predetermined film thickness was attained to effect an organic resin dispersed nickel-phosphorus composite plating (Ni—P-PTFE(1)) containing 20 to 25 vol % of tetrafluoroethylene resin (1), and then the specimen was washed in water and dried. Thereafter, the spacer and the blade were unwound and separated to obtain a double-layer-plated blade 1 having a Ni—P—SiC (3) plating and a layer provided thereon and consisting of a nickel-phosphorus-based composite plating layer in which PTFE (1) was dispersed (Ni—P-PTFE (1)).

Post-Treatment Process;

Exclusively the blade edge end of the above double-layer-plated blade 1 was polished with a abrasive paper of #2000 to remove the surface treatment coating exclusively from the blade edge end, whereby the blade base material was completely exposed. Thereafter, annealing was performed thereon at 300° C. for an hour, and the specimen was sheared in a predetermined size. The surface hardness (Hv), coating film thickness, and surface energy of this surface treated doctor blade were measured. Further, property for continuous printing, ink scraping property, and coating film adhesion were evaluated in the same manner as in Example 1. Further, conformability of the blade edge end was evaluated by the following evaluation criteria:

(1) Blade Edge End Conformability

With respect to a printing machine in which a blade according to Example 66 was mounted, a running-in was conducted using an oil-based ink. Evaluation was made on the basis of the length of time immediately from the time when the operation started until the time when normal printing without involving any printing failure in printed product, such as streaks, fogs, blurring, or bleeding started.

◎: less than five minutes

○: not less than five minutes and less than 30 minutes

Δ: not less than 30 minutes and less than 60 minutes

X: not less than 60 minutes

Table 5 collectively shows the measurement and evaluation results regarding the thickness (A) of the first layer, thickness (B) of the second layer, the amount of tetrafluoroethylene resin (PTFE) contained in the second layer, surface energy of the second layer, total thickness (A+B), thickness ratio (B/A), surface hardness (Hv), property for continuous printing, ink scraping property, coating film adhesion, and blade edge end conformability of this surface treated doctor blade.

EXAMPLES 67 TO 101

Plating Process;

As in Example 66, an appropriate pre-treatment was performed on a single-and-parallel-edged steel base material for doctor blade (a steel strip with a total length of 50 m) having a plate width of 50 mm, a plate thickness of 0.15 mm, a blade edge width of 1.4 mm, and a blade edge end thickness of 0.07 mm, and then the base material was immersed in an electroless Ni plating solution in which various types of SiC (SiC (1) to SiC (5)) with the average particle sizes as shown in Table 7 were dispersed, at 87° C. until a predetermined film thickness was attained to thereby effect an SiC containing nickel-phosphorus composite plating (Ni—P—SiC (1) to (5)). After being washed in water, the specimen was immersed in an electroless Ni plating solution in which various types of tetrafluoroethylene resin (PTFE (1) to (8)) with the average particle sizes as shown in Table 6 were dispersed, at 86° C. until a predetermined film thickness was attained to thereby effect a nickel-phosphorus composite plating containing the tetrafluoroethylene resin ((Ni—P-PTFE (1) to (8)). After being washed in water, the specimen was dried. Thereafter, the spacer and the blade were unwound and separated, and then a double-layer-plated blade 1 was obtained.

Post-Treatment Process;

Exclusively the blade edge end of the above double-layer-plated blade 1 was polished with a abrasive paper of #2000 to remove the surface treatment coating exclusively from the blade edge end, where the blade base material was completely exposed. Thereafter, annealing was performed thereon at 300° C. for an hour, and the specimen was sheared in a predetermined size. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the measurement and evaluation results.

EXAMPLES 102 TO 106

Plating Process 1;

As in Example 66, an appropriate pre-treatment was performed on a single-and-parallel-edged steel base material for doctor blade (a steel strip with a total length of 50 m) having a plate width of 50 mm, a plate thickness of 0.15 mm, a blade edge width of 1.4 mm, and a blade edge end thickness of 0.07 mm, and then the base material was immersed in an electroless Ni plating solution in which SiC (3) particles were dispersed (plating solution manufactured by Japan Kanigen Co., Ltd.; Sumer SC-80-1: 20 vol %, Sumer SC-80-4: 2 vol %), at 87° C. until a predetermined film thickness was attained to thereby effect a ceramic-dispersed nickel-phosphorus composite plating containing SiC (Ni—P—SiC (3)). After being washed in water, the specimen was dried. Thereafter, the spacer and the blade were unwound and separated, and then a single-layer-plated blade 1 was obtained.

Surface Adjustment Process;

Buff polishing was performed on the above-mentioned single-layer-plated blade 1 to completely remove the plating residues or the like from the surface. After performing annealing at 300° C. for an hour, there was obtained a single-layer-plated blade 2.

Coating Process;

A resin coating material containing the resin as shown in Table 5 was applied to the single-layer-plated blade 2 by using a roll coater such that the film thickness when dried was 1 μm, and then dried in a hot-air drying furnace, thereby obtaining a double-layer-treated blade.

Post-Treatment Process;

Exclusively the blade edge end of the above double-layer-treated blade was polished with a abrasive paper of #2000 to remove the surface treatment coating exclusively from the blade edge end, where the blade base material was completely exposed. Thereafter, the specimen was sheared in a predetermined size. The surface hardness (Hv), coating film thickness, and surface energy of this surface treated doctor blade were measured.

Further, conformability of the blade edge end, property for continuous printing, ink scraping property, and coating film adhesion of this surface treated doctor blade were measured and evaluated in the same manner as in Example 66. Table 5 shows the measurement and evaluation results.

EXAMPLE 107

Plating Process 1;

As in Example 66, an appropriate pre-treatment was performed on a single-and-parallel-edged steel base material for doctor blade (a steel strip with a total length of 50 m)

having a plate width of 50 mm, a plate thickness of 0.15 mm, a blade edge width of 1.4 mm, and a blade edge end thickness of 0.07 mm, and then the base material was immersed in an electroless Ni plating solution in which boron nitride (BN) was dispersed, at 87° C. until a predetermined film thickness was attained to thereby effect nickel-phosphorus composite plating containing boron nitride (BN) (Ni—P—BN). After being washed in water, the specimen was dried. Thereafter, the spacer and the blade were unwound and separated, and then a single-layer-plated blade 1 was obtained.

Surface Adjustment Process;

Buff polishing was performed on the above-mentioned single-layer-plated blade 1 to completely remove the plating residues or the like from the surface, thereby obtaining a single-layer-plated blade 2.

Plating Process 2;

The single-layer-plated blade 2 was subjected to the pre-treatment described in Plating process 2 of Example 66, and was immersed in an electroless Ni plating solution in which a tetrafluoroethylene resin (1) (PTFE(1)) (average particle size: 0.22 μm) was dispersed (a plating solution manufactured by Japan Kanigen Co., Ltd. (Kaniflon-0: 20 vol %, Kaniflon-4A (a solution in which tetrafluoroethylene resin (1) was dispersed): 2 vol %) at 86° C. until a predetermined film thickness was attained to effect an organic resin dispersed nickel-phosphorus composite plating (Ni—P-PTFE(1)) containing 20 to 25 vol % of tetrafluoroethylene resin (1), and then the specimen was washed in water and dried. Thereafter, the spacer and the blade were unwound and separated to obtain a double-layer-plated blade 1.

Post-Treatment Process;

Exclusively the blade edge end of the above double-layer-plated blade 1 was polished with a abrasive paper of #2000 to remove the surface treatment coating film exclusively from the blade edge end, where the blade base material was completely exposed. Thereafter, annealing was performed thereon at 300° C. for an hour, and the specimen was sheared in a predetermined size. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows results thereof.

EXAMPLE 108

A surface-treated blade with its base material exposed exclusively at the blade edge end by removing the surface treatment coating was prepared through the same manner as that in Example 66, except that plating which contained no ceramic was given as the first layer. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the measurement and evaluation results.

COMPARATIVE EXAMPLE 10

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/L) of 50° C. for 15 minutes. After being washed in water, the specimen was subjected to hydrochloric acid activation treatment in a hydrochloric acid activation solution for 15 minutes and further washed in water. Thereafter, the specimen was immersed in an electroless Ni plating solution in which SiC (3) was dispersed (a plating solution manufactured by Japan Kanigen Co., Ltd. (SC-80-1: 20 vol %, SC-80-4: 2 vol %) at 87° C. until a predetermined film thickness was attained to effect a nickel-phosphorus composite plating containing SiC (3) (Ni—P—Sic (3)). After being washed in water, the specimen was dried. Thereafter, the spacer and the blade were unwound and separated to thereby obtain a single-layer-plated blade 1.

Surface Adjustment Process;

Buff polishing was performed on the above-mentioned single-layer-plated blade 1 to completely remove the plating residues or the like from the surface, thereby obtaining a single-layer-plated blade 2.

Post-Treatment Process;

Exclusively the blade edge end of the above single-layer-plated blade 2 was polished with a abrasive paper of #2000 to remove the surface treatment coating film exclusively from the blade edge end, where the blade base material was completely exposed. Thereafter, annealing was performed thereon at 300° C. for an hour, and the specimen was sheared in a predetermined size. The surface hardness (Hv) and coating film thickness of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the results thereof.

COMPARATIVE EXAMPLE 11

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/L) of 50° C. for 15 minutes. After being washed in water, the specimen was subjected to hydrochloric acid activation treatment in a hydrochloric acid activation solution for 15 minutes to be further washed in water. Thereafter, the specimen was immersed in an electroless Ni plating solution in which a tetrafluoroethylene resin (1) (PTFE(1)) was dispersed (a plating solution manufactured by Japan Kanigen Co., Ltd. ((Kaniflon-0: 20 vol %, Kaniflon-4A (a solution in which the tetrafluoroethylene resin (1) is dispersed): 2 vol %) at 86° C. until a predetermined coating film thickness was attained to effect a nickel-phosphorus composite plating (Ni—P-PTFE(1))containing 20 to 25 vol % of tetrafluoroethylene resin (1). After being washed in water, the specimen was dried. Thereafter, the spacer and the blade were unwound and separated to thereby obtain a single-layer-plated blade 1.

Surface Adjustment Process;

Buff polishing was performed on the above-mentioned single-layer-plated blade 1 to completely remove the plating residues or the like from the surface, thereby obtaining a signle-layer-plated blade 2.

Post-Treatment Process;

Exclusively the blade edge end portion of the above single-layer-plated blade 2 was polished with a abrasive paper of #2000 to remove the surface treatment coating film exclusively from the blade edge end, where the blade base material was completely exposed. Thereafter, annealing was performed thereon at 300° C. for an hour, and the specimen was sheared in a predetermined size. The surface hardness (Hv) and coating film thickness of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the results thereof.

COMPARATIVE EXAMPLE 12

A surface treated blade having a treatment coating also, at the blade edge end was produced through the same process as in Comparative Example 10 except that the step of polishing the blade edge end with a #2000 abrasive paper was omitted. The surface hardness (Hv) and coating film thickness of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the results thereof.

COMPARATIVE EXAMPLE 13

A surface treated blade having a treatment coating also at the blade edge end was produced through the same process as in Comparative Example 11 except that the step of polishing the blade edge end with a #2000 abrasive paper was omitted. The surface hardness (Hv) and coating film thickness of this surface treated doctor blade were measured, and conformability of the blade edge end, property for continuous printing, ink scraping property, and coating film adhesion of this surface treated doctor blade were measured and evaluated in the same manner as in Example 66. Table 5 shows the measurement and evaluation results.

COMPARATIVE EXAMPLE 14

Plating Process 1;

A single-and-parallel-edged steel base material for doctor blade (a steel strip having a total length of 50 m) having a plate width of 50 mm, a plate thickness of 0.15 mm, a blade edge width of 1.4 mm, and a blade edge end thickness of 0.07 mm was spirally taken up on a reel together with a spacer consisting of a metal steel strip which had the surface roughened by embossing treatment, and in the state in which it was wound around the reel, it was immersed in an alkali degreasing solution (Pakuna RT-T (manufactured by Yuken Industry Co., Ltd.) 60 g/liter) of 50° C. for 15 minutes. After being washed in water, the specimen was subjected to hydrochloric acid activation treatment in a hydrochloric acid activation solution for 15 minutes, and further washed in water. Thereafter, the specimen was immersed in an electroless Ni plating solution in which a tetrafluoroethylene resin (1) (PTFE(1)) was dispersed (a plating solution manufactured by Japan Kanigen Co., Ltd. ((Kaniflon-0: 20 vol %, Kaniflon-4A (a solution in which tetrafluoroethylene resin (1) was dispersed): 2 vol %) at 86° C. until a predetermined film thickness was attained to effect a nickel-phosphorus composite plating (Ni—P-PTFE (1)) containing 20 to 25 vol % of tetrafluoroethylene resin (1). After being washed in water, the specimen was dried. Thereafter, the spacer and the blade were unwound and separated to thereby obtain a single-layer-plated blade 1.

Surface Adjustment Process;

Buff polishing was performed on the above-mentioned single-layer-plated blade 1 to completely remove the plating residues or the like from the surface, thereby obtaining a single-layer-plated blade 2.

Plating Process 2;

Further, in the same manner as in Plating process 1 of Example 66, there was effected a nickel-phosphorus composite plating (Ni—P—SiC (3)) containing SiC (3). After being washed in water, the specimen was dried. Thereafter, the spacer and the blade were unwound and separated to thereby obtain a double-layer-plated blade 1.

Post-Treatment Process;

Exclusively the blade edge end of the above double-layer-plated blade 1 was polished with a abrasive paper of #2000 to remove the surface treatment coating film exclusively from the blade edge end, where the blade base material was completely exposed. Thereafter, annealing was performed thereon at 300° C. for an hour, and the specimen was sheared in a predetermined size. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured evaluated in the same manner as in Example 66. Table 5 shows the results thereof.

COMPARATIVE EXAMPLE 15

The same treatment as that in Example 66, except a nickel-phosphorus alloy plating (Ni—P) containing no fluorine-based resin, was performed to provide a second layer. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the results thereof.

COMPARATIVE EXAMPLE 16

As in Example 66, an SiC particle-containing nickel-phosphorus-based composite plating (Ni—P—SiC (3)) was performed to provide a first layer, and annealing was conducted at 300° C. for an hour. Thereafter, an epoxy resin coating material was applied as a second layer. After baking the coating layer, the specimen was sheared in a predetermined size. The surface hardness (Hv), coating film thickness, and surface energy of this surface treated doctor blade were measured. Further, conformability of the blade edge end, property for continuous printing, ink scraping property, and coating film adhesion of this surface treated doctor blade were measured and evaluated in the same manner as in Example 66. Table 5 shows the measurement and evaluation results.

TABLE 5

Surface treated doctor blade and quality performance

| | No. | base material of blade edge end | First layer Type | First layer Film thickness (A) (μm) | Second layer Type | Second layer PTFE content (vol %) | Second layer Film thickness (B) (μm) | Second layer Surface energy | Total film thickness (A +B) |
|---|---|---|---|---|---|---|---|---|---|
| Example | 66 | Exposed | Ni—P—SiC(3) | 6 | Ni—P-PTFE(1) | 20 to 25 | 1 | Low | 7 |
| | 67 | Exposed | Ni—P—SiC(3) | 7 | Ni—P-PTFE(1) | 20 to 25 | 1 | Low | 8 |
| | 68 | Exposed | Ni—P—SiC(3) | 6 | Ni—P-PTFE(1) | 3 to 7 | 1 | Low | 7 |
| | 69 | Exposed | Ni—P—SiC(3) | 6 | Ni—P-PTFE(1) | 10 to 15 | 1 | Low | 7 |
| | 70 | Exposed | Ni—P—SiC(3) | 6 | Ni—P-PTFE(1) | 30 to 35 | 1 | Low | 7 |
| | 71 | Exposed | Ni—P—SiC(3) | 6 | Ni—P-PTFE(1) | 45 to 50 | 1 | Low | 7 |
| | 72 | Exposed | Ni—P—SiC(3) | 6 | Ni—P-PTFE(2) | 20 to 25 | 1 | Low | 7 |
| | 73 | Exposed | Ni—P—SiC(3) | 6 | Ni—P-PTFE(3) | 20 to 25 | 1 | Low | 7 |
| | 74 | Exposed | Ni—P—SiC(3) | 6 | Ni—P-PTFE(4) | 20 to 25 | 1 | Low | 7 |
| | 75 | Exposed | Ni—P—SiC(3) | 6 | Ni—P-PTFE(5) | 20 to 25 | 1 | Low | 7 |
| | 76 | Exposed | Ni—P—SiC(3) | 7 | Ni—P-PTFE(6) | 20 to 25 | 2 | Low | 9 |
| | 77 | Exposed | Ni—P—SiC(3) | 7 | Ni—P-PTFE(7) | 20 to 25 | 2 | Low | 9 |
| | 78 | Exposed | Ni—P—SiC(3) | 7 | Ni—P-PTFE(8) | 20 to 25 | 2 | Low | 9 |
| | 79 | Exposed | Ni—P—SiC(3) | 6 | Ni—P-PTFE(1) | 20 to 25 | 1 | Low | 7 |
| | 80 | Exposed | Ni—P—SiC(3) | 6 | Ni—P-PTFE(1) | 20 to 25 | 1 | Low | 7 |
| | 81 | Exposed | Ni—P—SiC(3) | 6 | Ni—P-PTFE(1) | 20 to 25 | 1 | Low | 7 |
| | 82 | Exposed | Ni—P—SiC(3) | 6 | Ni—P-PTFE(1) | 20 to 25 | 1 | Low | 7 |
| | 83 | Exposed | Ni—P—SiC(3) | 6 | Ni—P-PTFE(1) | 20 to 25 | 1 | Low | 7 |
| | 84 | Exposed | Ni—P—SiC(3) | 6 | Ni—P-PTFE(1) | 20 to 25 | 1 | Low | 7 |
| | 85 | Exposed | Ni—P—SiC(3) | 6 | Ni—P-PTFE(1) | 20 to 25 | 1 | Low | 7 |
| | 86 | Exposed | Ni—P—SiC(3) | 2.1 | Ni—P-PTFE(4) | 20 to 25 | 0.4 | Low | 2.5 |
| | 87 | Exposed | Ni—P—SiC(3) | 3.3 | Ni—P-PTFE(1) | 20 to 25 | 0.7 | Low | 4 |
| | 88 | Exposed | Ni—P—SiC(3) | 5 | Ni—P-PTFE(1) | 20 to 25 | 1 | Low | 6 |
| | 89 | Exposed | Ni—P—SiC(3) | 10 | Ni—P-PTFE(1) | 20 to 25 | 2 | Low | 12 |
| | 90 | Exposed | Ni—P—SiC(3) | 16 | Ni—P-PTFE(1) | 20 to 25 | 4 | Low | 20 |
| | 91 | Exposed | Ni—P—SiC(3) | 21 | Ni—P-PTFE(1) | 20 to 25 | 4 | Low | 25 |
| | 92 | Exposed | Ni—P—SiC(3) | 7.7 | Ni—P-PTFE(4) | 20 to 25 | 0.3 | Low | 8 |
| | 93 | Exposed | Ni—P—SiC(3) | 7.5 | Ni—P-PTFE(1) | 20 to 25 | 0.5 | Low | 8 |
| | 94 | Exposed | Ni—P—SiC(3) | 7.1 | Ni—P-PTFE(1) | 20 to 25 | 0.9 | Low | 8 |
| | 95 | Exposed | Ni—P—SiC(3) | 6.2 | Ni—P-PTFE(1) | 20 to 25 | 1.8 | Low | 8 |
| | 96 | Exposed | Ni—P—SiC(3) | 5.3 | Ni—P-PTFE(1) | 20 to 25 | 2.7 | Low | 8 |
| | 97 | Exposed | Ni—P—SiC(3) | 3.6 | Ni—P-PTFE(1) | 20 to 25 | 4.4 | Low | 8 |
| | 98 | Exposed | Ni—P—SiC(1) | 6 | Ni—P-PTFE(1) | 20 to 25 | 1 | Low | 7 |
| | 99 | Exposed | Ni—P—SiC(2) | 6 | Ni—P-PTFE(1) | 20 to 25 | 1 | Low | 7 |
| | 100 | Exposed | Ni—P—SiC(4) | 6 | Ni—P-PTFE(1) | 20 to 25 | 1 | Low | 7 |
| | 101 | Exposed | Ni—P—SiC(5) | 6 | Ni—P-PTFE(1) | 20 to 25 | 1 | Low | 7 |
| | 102 | Exposed | Ni—P—SiC(3) | 7 | Acrylic resin containing PTFE(5) | 20 to 25 | 1 | Low | 8 |
| | 103 | Exposed | Ni—P—SiC(3) | 7 | Silicone-based resin | — | 1 | Low | 8 |
| | 104 | Exposed | Ni—P—SiC(3) | 7 | PTFE resin | — | 1 | Low | 8 |
| | 105 | Exposed | Ni—P—SiC(3) | 7 | Perfluoroalkoxy-based resin | — | 1 | Low | 8 |
| | 106 | Exposed | Ni—P—SiC(3) | 7 | Fluorinated ethylene propylene-based resin | — | 1 | Low | 8 |
| | 107 | Exposed | Ni—P-BN | 7 | Ni—P-PTFE(1) | 20 to 25 | 1 | Low | 8 |
| | 108 | Exposed | Ni—P | 7 | Ni—P-PTFE(1) | 20 to 25 | 1 | Low | 8 |
| Comparative Example | 10 | Exposed | Ni—P—SiC(3) | 7 | — | — | — | — | 7 |
| | 11 | Exposed | Ni—P-PTFE(1)*1 | 7 | — | — | — | — | 7 |
| | 12 | Not exposed | Ni—P—SiC(3) | 7 | — | — | — | — | 7 |
| | 13 | Not exposed | Ni—P-PTFE(1)*1 | 7 | — | — | — | — | 7 |
| | 14 | Exposed | Ni—P-PTFE(1)*1 | 6 | Ni—P—SiC(3) | — | 1 | High | 7 |
| | 15 | Exposed | Ni—P—SiC(3) | 6 | Ni—P | 0 | 1 | High | 7 |
| | 16 | Exposed | Ni—P—SiC(3) | 7 | Epoxy resin | — | 1 | High | 8 |

| | No. | Film thickness ratio (B/A) | Hardness (Hv) | Blade tip conformability | Continuous printing characteristic | Ink scraping property | Coating film adhesion |
|---|---|---|---|---|---|---|---|
| Example | 66 | 0.17 | 1000 | ◎ | ◎ | ◎ | ○ |
| | 67 | 0.14 | 1000 | ◎ | ◎ | ◎ | ○ |
| | 68 | 0.17 | 1000 | ○ | ○ | ○ | ○ |
| | 69 | 0.17 | 1000 | ◎ | ◎ | ○ | ○ |
| | 70 | 0.17 | 1000 | ◎ | ○ | ◎ | ○ |
| | 71 | 0.17 | 1000 | ◎ | ○ | ○ | Δ |

TABLE 5-continued

| Surface treated doctor blade and quality performance | | | | | | | |
|---|---|---|---|---|---|---|---|
| | 72 | 0.17 | 1000 | ◎ | Δ | ◎ | Δ |
| | 73 | 0.17 | 1000 | ◎ | ○ | ◎ | ○ |
| | 74 | 0.17 | 1000 | ◎ | ◎ | ◎ | ○ |
| | 75 | 0.17 | 1000 | ◎ | ◎ | ◎ | ○ |
| | 76 | 0.29 | 1000 | ◎ | ◎ | ○ | ○ |
| | 77 | 0.29 | 1000 | ◎ | ○ | ○ | ○ |
| | 78 | 0.29 | 1000 | ◎ | Δ | ○ | Δ |
| | 79 | 0.17 | 500 | ◎ | Δ | ○ | ○ |
| | 80 | 0.17 | 750 | ◎ | ○ | ◎ | ○ |
| | 81 | 0.17 | 850 | ◎ | ◎ | ◎ | ○ |
| | 82 | 0.17 | 900 | ◎ | ◎ | ◎ | ○ |
| | 83 | 0.17 | 1100 | ◎ | ◎ | ◎ | ○ |
| | 84 | 0.17 | 1200 | ◎ | ○ | ◎ | ○ |
| | 85 | 0.17 | 1350 | ◎ | Δ | ○ | Δ |
| | 86 | 0.19 | 720 | ◎ | Δ | ○ | ○ |
| | 87 | 0.21 | 900 | ◎ | ○ | ◎ | ○ |
| | 88 | 0.20 | 1000 | ◎ | ◎ | ◎ | ○ |
| | 89 | 0.20 | 1000 | ◎ | ○ | ◎ | ○ |
| | 90 | 0.25 | 1000 | ◎ | ○ | ◎ | Δ |
| | 91 | 0.19 | 1000 | ◎ | Δ | ○ | Δ |
| | 92 | 0.04 | 1100 | ◎ | ○ | Δ | ○ |
| | 93 | 0.07 | 1100 | ◎ | ◎ | ○ | ○ |
| | 94 | 0.12 | 1000 | ◎ | ◎ | ◎ | ○ |
| | 95 | 0.29 | 1000 | ◎ | ◎ | ◎ | ○ |
| | 96 | 0.50 | 900 | ◎ | ○ | ◎ | ○ |
| | 97 | 1.22 | 750 | ◎ | Δ | ○ | ○ |
| | 98 | 0.17 | 800 | ◎ | ○ | ○ | ○ |
| | 99 | 0.17 | 900 | ◎ | ◎ | ○ | ○ |
| | 100 | 0.17 | 1000 | ◎ | ○ | ◎ | ○ |
| | 101 | 0.17 | 1000 | ◎ | Δ | ○ | Δ |
| | 102 | 0.14 | 1000 | ◎ | ◎ | ◎ | ○ |
| | 103 | 0.14 | 1000 | ◎ | ○ | ○ | ○ |
| | 104 | 0.14 | 1000 | ◎ | ◎ | ◎ | ○ |
| | 105 | 0.14 | 1000 | ◎ | ◎ | ○ | ○ |
| | 106 | 0.14 | 1000 | ◎ | ◎ | ○ | ○ |
| | 107 | 0.14 | 1000 | ◎ | ○ | ◎ | Δ |
| | 108 | 0.17 | 750 | ◎ | Δ | ○ | ○ |
| Comparative Example | 10 | — | 1000 | ○ | Δ | X | ○ |
| | 11 | — | 500 | ○ | X | X | ○ |
| | 12 | — | 1000 | X | Δ | X | ○ |
| | 13 | — | 600 | X | X | X | ○ |
| | 14 | 0.17 | 900 | Δ | X | X | X |
| | 15 | 0.17 | 900 | Δ | Δ | X | ○ |
| | 16 | 0.14 | 1000 | Δ | Δ | X | ○ |

*[1]PTFE content is 20 to 25 vol %

TABLE 6

| Particle size of PTFE | |
|---|---|
| | Particle size (υm) |
| PTFE(1) | 0.22 |
| PTFE(2) | 0.06 |
| PTFE(3) | 0.12 |
| PTFE(4) | 0.16 |
| PTFE(5) | 0.35 |
| PTFE(6) | 0.7 |
| PTFE(7) | 1.5 |
| PTFE(8) | 6 |

TABLE 7

| Particle size of SiC particle | |
|---|---|
| | Particle size(μm) |
| SiC(1) | 0.07 |
| SiC(2) | 0.1 |
| SiC(3) | 0.5 |

TABLE 7-continued

| Particle size of SiC particle | |
|---|---|
| | Particle size(μm) |
| SiC(4) | 1.5 |
| SiC(5) | 3 |

INDUSTRIAL APPLICABILITY

In the surface treated doctor blade of the present invention, which has a first layer consisting of a nickel-based plating or a chromium-based plating and a second layer provided thereon and having low surface energy, an improvement is achieved in terms of wear resistance of the blade edge end, thereby restraining generation of printing failures during continuous printing. In the mode in which at least a part of the blade base material is exposed, it is possible to reduce running-in time for adjustment of contact of the blade edge with the cylinder. In accordance with the present invention, it is possible to produce a doctor blade with the above properties with low cost.

The invention claimed is:

1. A surface treated doctor blade comprising a doctor blade base material, wherein at least both sides of a blade edge of said base material has a coating which comprises a first layer consisting of a nickel-based plating or a chromium-based plating (exclusive of an organic resin dispersed composite plating in which organic resin particles are dispersed) and a second layer provided thereon which has low surface energy and the ratio (B/A) of the film thickness (B) of the second layer to the film thickness (A) of the first layer is within a range of 0.005 to 0.6, wherein the sum total of a film thickness (A) of the first layer and a film thickness (B) of the second layer is within a range of 2 μm to 30 μm, and wherein the first layer is a nickel-phosphorous-based composite plating containing SiC particles having the particle size of 0.05 to 10 μm and the second layer is a layer consisting of an organic resin dispersed nickel-phosphorous-based composite plating containing tetrafluoroethylene-based resin particles having the particle size of 0.05 to 10 μm.

2. The surface treated doctor blade as claimed in claim 1, wherein Vickers hardness (Hv) of the doctor blade is within a range of 400 to 1500.

3. The surface treated doctor blade as claimed in claim 1, wherein the blade base material of the blade edge end portion is exposed at least in a part.

4. The surface treated doctor blade as claimed in claim 1, wherein the particle size of the tetrafluoroethylene-based resin particles is not more than 1.2 times the plating thickness of the second layer.

5. The surface treated doctor blade as claimed in claim 1, wherein the blade base material of the blade edge end portion is exposed at least in a part and the particle size of the tetrafluoroethylene-based resin particles is not more than 1.2 times the plating thickness of the second layer.

6. The surface treated doctor blade as claimed in claim 1, wherein an entire surface of said base material has said base coating.

* * * * *